United States Patent [19]

Fleischhacker et al.

[11] 3,975,812

[45] Aug. 24, 1976

[54] APPARATUS FOR APPLYING WIRE CONNECTING DEVICES TO PAIRS OF WIRES

[75] Inventors: James Earl Fleischhacker, Clearwater; Vincent Nicholas, Brooksville; Henry George Wasserlein, Jr., Seminole, all of Fla.

[73] Assignee: AMP Incorporated, Harrisburg, Pa.

[22] Filed: May 12, 1975

[21] Appl. No.: 576,932

[52] U.S. Cl. ..... 29/203 MW; 29/203 DT

[51] Int. Cl.[2] ..... H01R 43/04

[58] Field of Search ..... 29/203 DT, 203 DS, 203 D, 29/203 MW, 203 HT, 203 H, 628, 33 M

[56] References Cited

UNITED STATES PATENTS

| | | | |
|---|---|---|---|
| 3,436,820 | 4/1969 | Reem et al. | 29/628 |
| 3,594,900 | 7/1971 | Dola et al. | 29/203 MW |
| 3,766,622 | 10/1973 | Brehm | 29/203 MW |

*Primary Examiner*—Carl E. Hall
*Attorney, Agent, or Firm*—F. W. Raring; R. W. Pitts; Jay L. Seitchik

[57] ABSTRACT

Apparatus for connecting pairs of wires to each other has an operating zone through which a continuous strip of connecting devices is fed from an entrance side to an exit side thereof. The connecting devices have wire-receiving ends which face laterally of the strip and have separate metallic connecting means in each of the ends. A pair of wires are located in the operating zone with one wire in alignment with each of the wire-receiving ends. Insertion punches on each side of the strip insert each wire into a metallic connecting means. The process is then repeated for the second pair of wires to connect the pairs to each other. The connectors are fed to the exit side of the operating zone, and removed from the strip. The apparatus can also be used for making tap connections to the conductors in a cable.

11 Claims, 25 Drawing Figures

8
62
10
12
18
20
22
26
28
30
32
32a
34
34a
36
36a
38
38a
40
40'
42
42'
44
48'
50
50'
54
54'
56'
2
3
16
20'

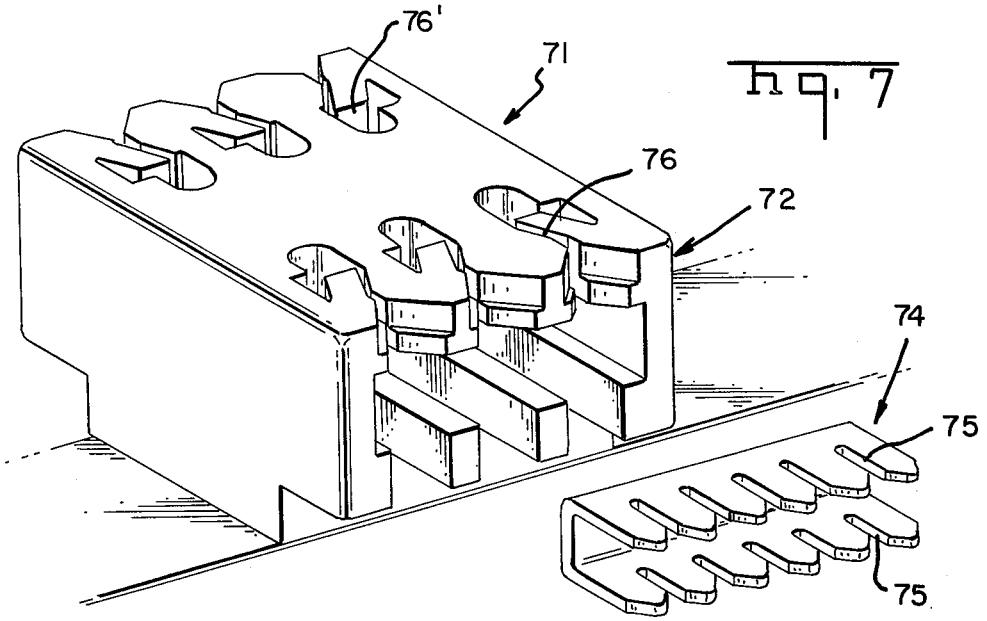
Fig. 7
Fig. 8
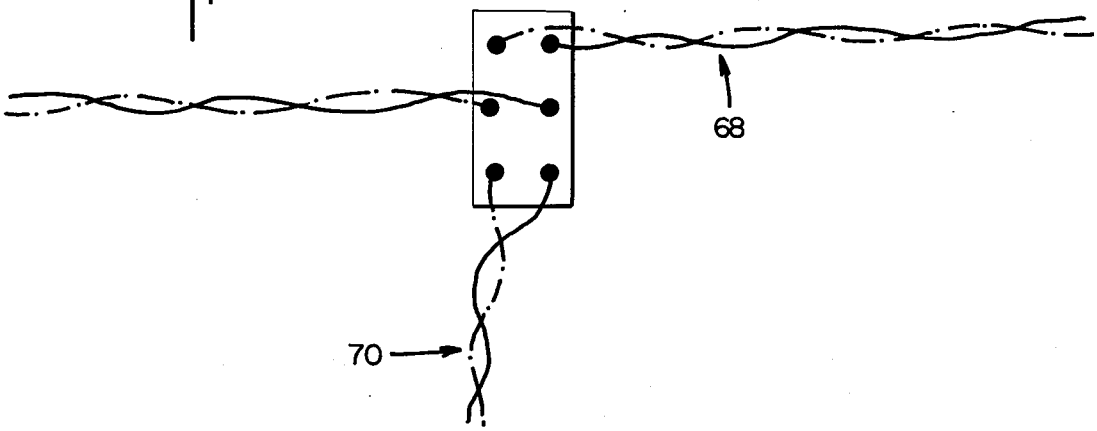
Fig. 8A
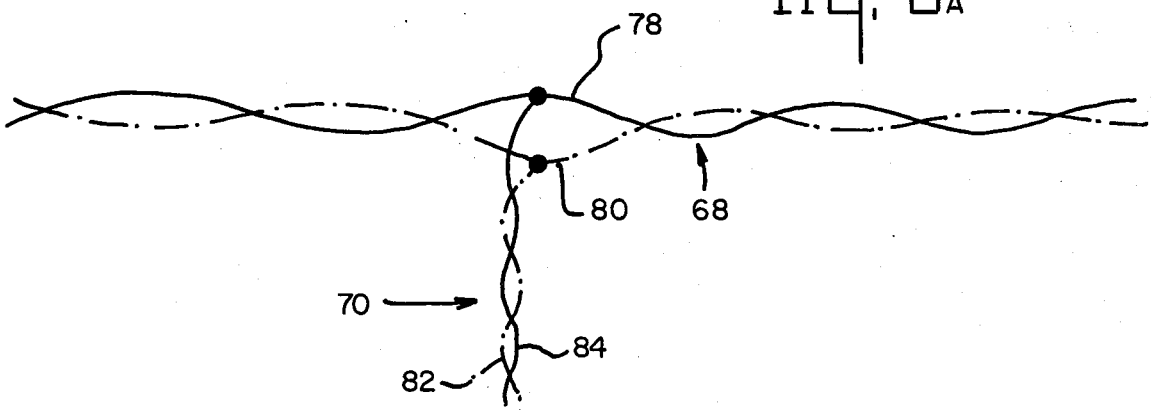

APPARATUS FOR APPLYING WIRE CONNECTING DEVICES TO PAIRS OF WIRES

BACKGROUND OF THE INVENTION

This invention relates to methods and apparatus for connecting the corresponding wires of associated pairs of wires to each other in separate electrical connections and for forming tap connections to pairs of wires. The invention is herein disclosed as an embodiment which is primarily intended for splicing the ends of two multi-conductor cables and for forming tap connections to the conductors in a multi-conductor cable. However, the principles of the invention can be employed under other circumstances which will be apparent from the following description.

Communications cables of the type used to carry telephone signals between different locations commonly comprise a plurality of pairs of insulated wires which are contained within an insulating sheath. These communication cables are made in several sizes, the largest of which contains 4200 pairs of AWB 22 wires. A commonly used size contains 3000 pairs of wires and has a diameter of about 3 inches although cables containing fewer than 3000 pairs are also widely used.

It will be apparent that communication cables can be manufactured only in limited lengths and that when the telephone line between two locations is initially installed, it is necessary to splice many sections of cable to each other at regular intervals. For example, a 3,000 pair cable is usually manufactured in 800 foot lengths which means that when a cable of this size is installed between two locations, a cable splice must be made every 800 feet and each splice requires 6,000 individual electrical connections to connect the individual wires in the end of one cable section to the wires in the adjoining cable section.

The first method used for joining wires in a cable splice was to simply twist the wires together and position a fabric insulating sleeve over the twisted splice connection between the two wires. In recent years, the twisting method has been largely replaced by electrical connectors of several different types. Simple pig-tail connecting devices which receive the ends of the two wires (in one end of the connector) hav been widely used as have crimped connecting devices which receive one wire at each end thereof. U.S. Pat. No. 3,328,872 shows the latter type of crimp-type connecting device and also discloses a simple hand tool for crimping the connector onto the wires. Module type connecting devices have also been employed to some extent. These devices comprise plastic modules which contain a plurality of meallic terminals, each of which receives two wires as shown in U.S. Pat. No. 3,496,522. The tooling for crimping connecting devices in communications cables is becoming highly developed and as a result, a substantial improvement in productivity has been achieved as a result of the use of connectors in cable splicing operations.

The production rates achieved by a craftsman splicing a telephone cable still leave much to be desired, notwithstanding the improvement of recent years. Production rates of 200 to 250 pairs of wires per hour are now being achieved but even at these rates, twelve or more hours are required to splice two sections of a 3,000 pair cable to each other. It will thus be apparent that there continues to be a need for further improvements in this art, particularly improvements which will increase the production rate of the technician engaged in a splicing operation.

The instant invention is specifically directed to an improved method and apparatus for cable splicing and particularly to the achievement of a substantial increase in splicing rates. In general, the method of the invention comprises feeding a strip of connectors from a reel along a path extending through an operating zone and linearly towards the cables being spliced. The wires in the cables are conveniently located on each side of the operating zone so that a wire pair can be moved into the zone by the operator with a minimum of effort. The wires are trimmed and inserted into a connecting device at an insertion station. The connecting device with the wire attached thereto is then delivered to the vicinity of the cable during a subsequent operating cycle.

It is accorcingly an object of the invention to provide an improved method and apparatus for connecting wires to each other. A further object is to provide an improved method and apparatus for splicing the ends of multi-conductor cables to each other. A further object is to provide a cable splicing apparatus which can be operated at a high production rate with a minimum of operator fatigue. A further object is to provide an improved pneumatically actuating cable splicing apparatus. A further object is to provide a compact and rugged power actuated apparatus for splicing electrical cables which can be used efficiently under unfavorable circumstances, such as in a manhole. A further object is to provide an apparatus which can be used for cable splicing operations and which can also be used to form tap connections to cables.

These and other objects of the invention are achieved in preferred embodiments thereof which are briefly described in the foregoing abstract, which are described in detail below, and which are shown in the accompanying drawing in which.

Figures 1, 1A:
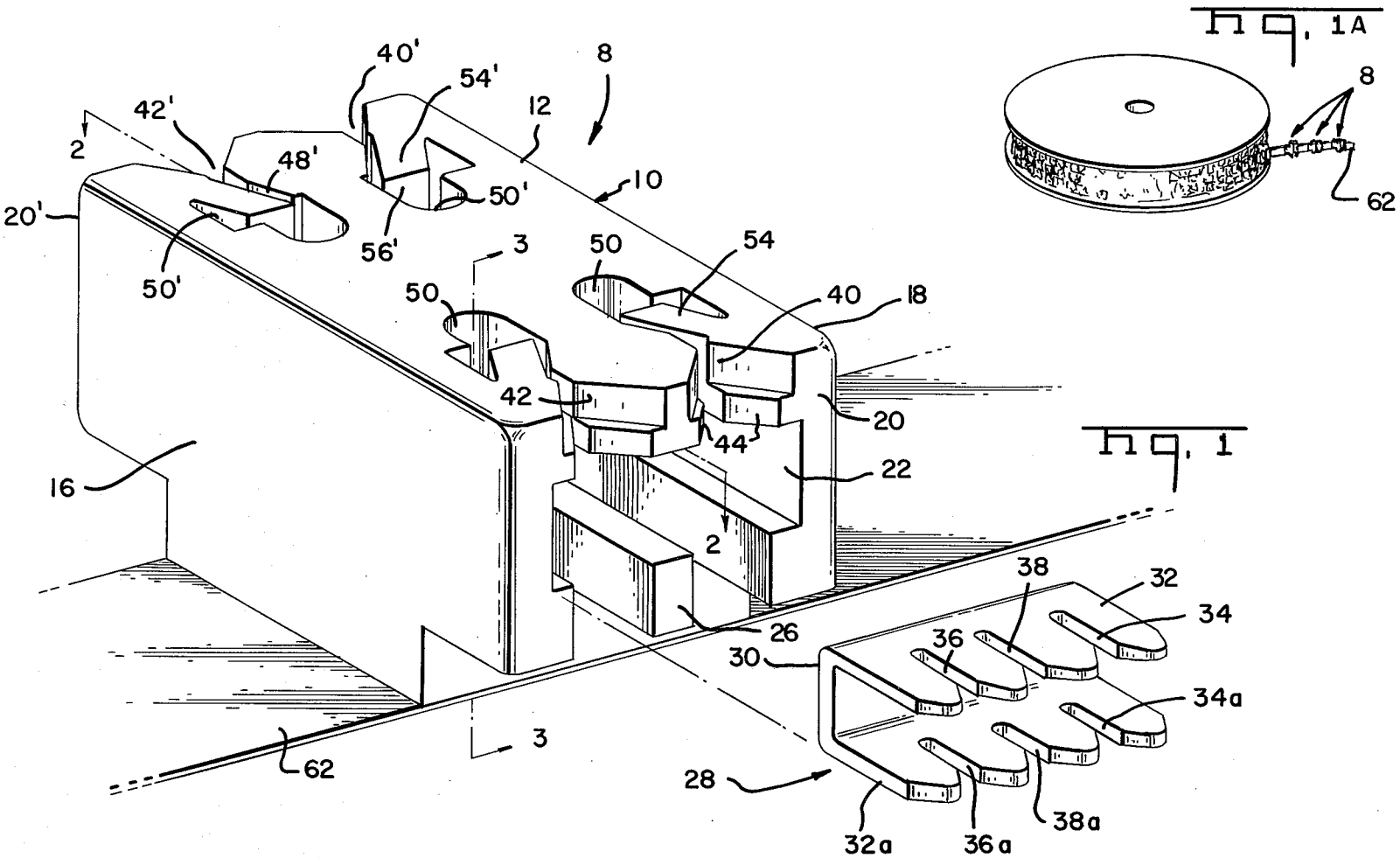
FIG. 1 is a perspective view of an electrical connecting device which is intended for use with the apparatus of the instant invention.
FIG. 1A is a perspective view of a reel of connecting devices of the type shown in FIG. 1.
Figure 2:
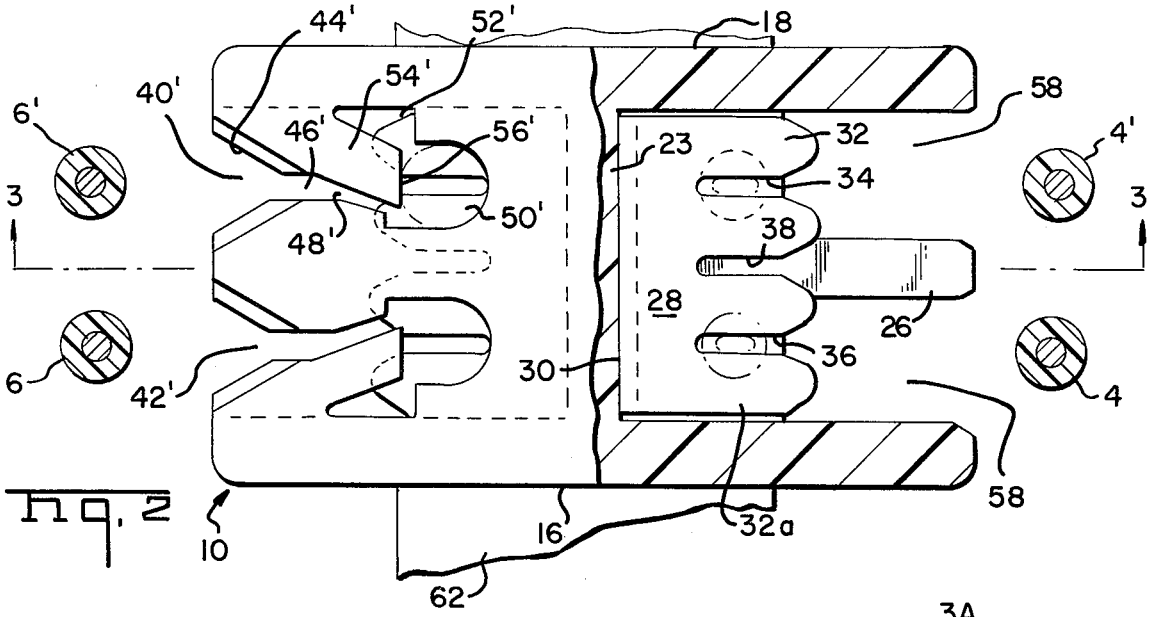
Figure 3:
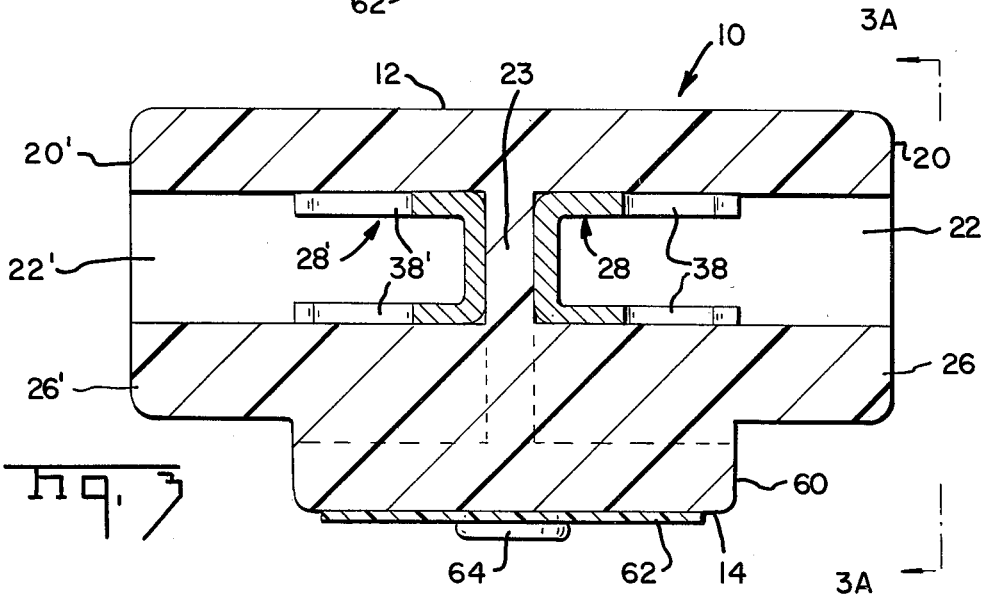

FIGS. 2 and 3 are views taken along the lines 2—2 and 3—3 of FIG. 1.

Figure 3A:
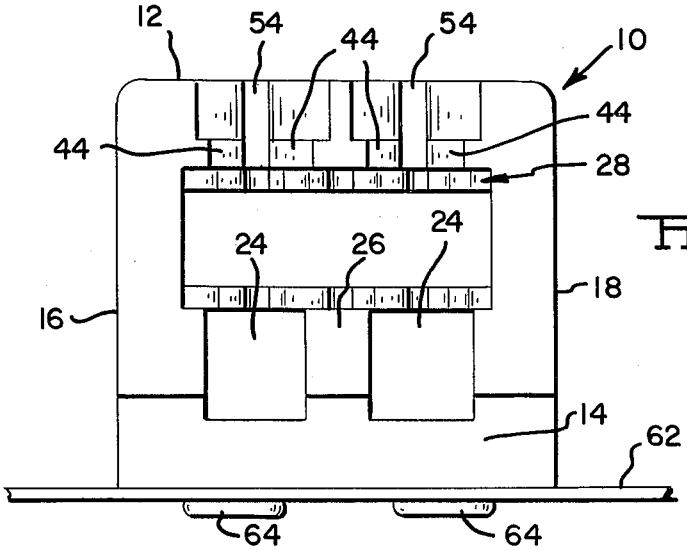

FIG. 3A is a view taken along the lines 3A—3A of FIG. 3.

Figure 4:
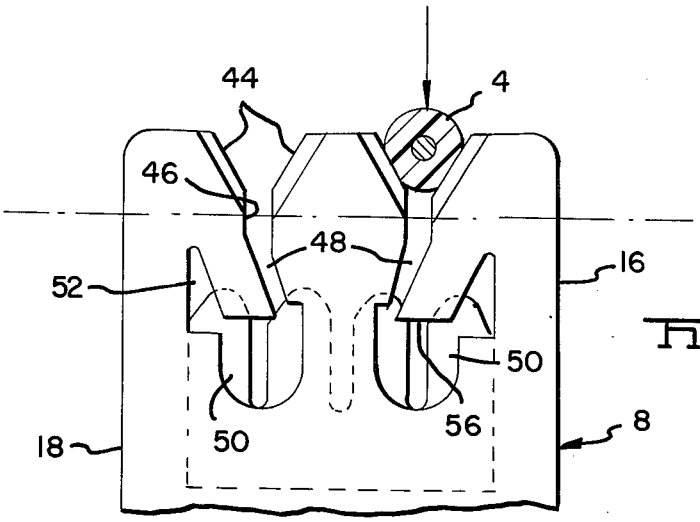
Figure 5:
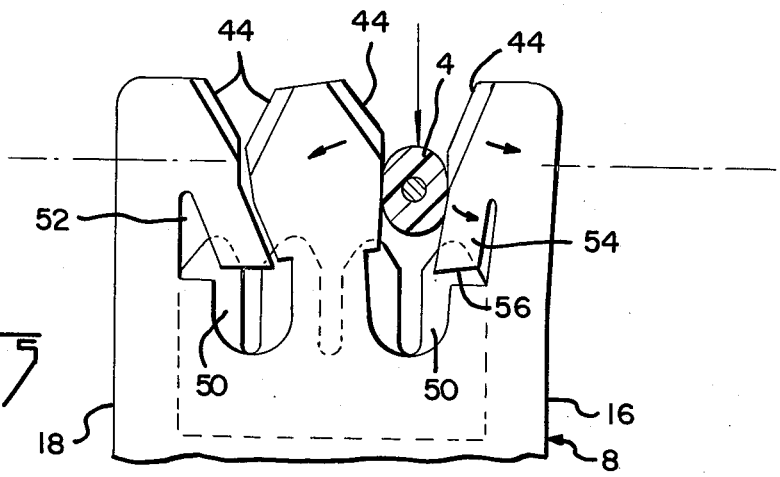
Figure 6:
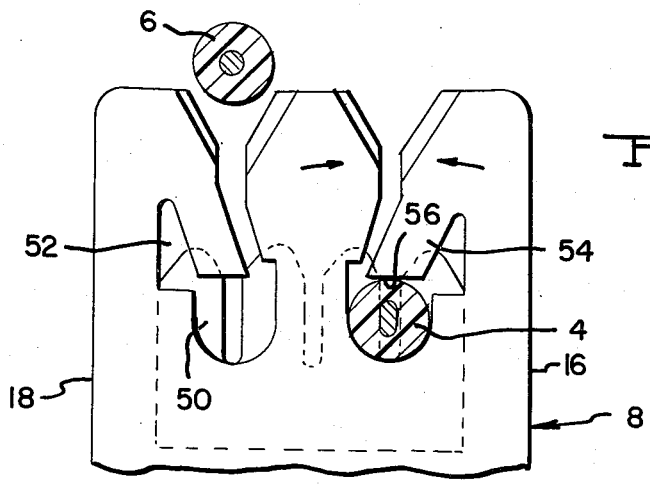

FIGS. 4–6 are fragmentary frontal views of a connecting device illustrating the movement of wires into one of the connecting device.

FIG. 7 is a perspective view of an alternative connecting device which is intended for making tap connections to the wires of a twisted pair of wires.

FIG. 8 is a perspective view of a tap connection between tap wires and the wires of a pair.

FIG. 8A is a wiring diagram of a tap connection.

Figure 9:
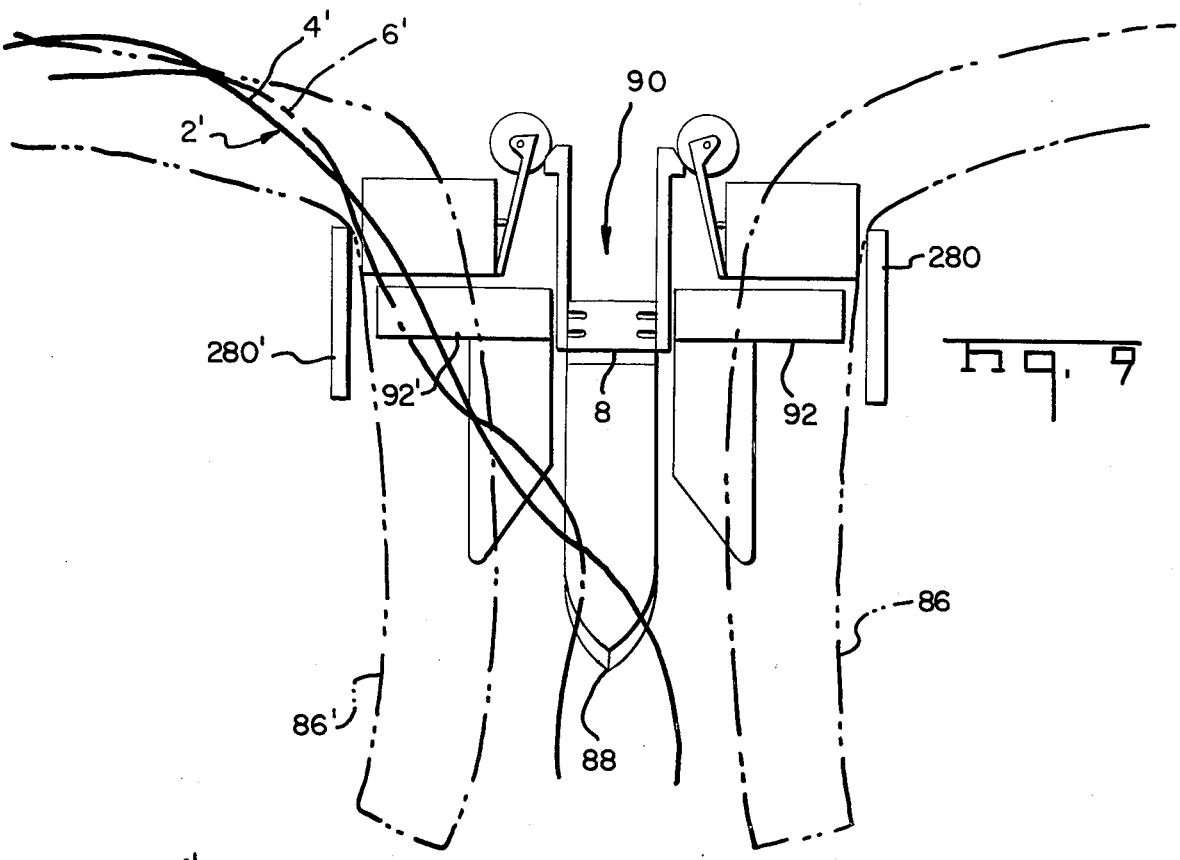

FIG. 9 is a semi-diagrammatic top plan view of an apparatus in accordance with the invention illustrating the manner in which bundles of wires are supported on the device and the manner of positioning one pair of wires in the apparatus; this view illustrates the first step in the sequence of operations required to connect the corresponding wires to two pairs or wires to each other.

FIGS. 10–13 are views similar to FIG. 9 illustrating the series of steps which are carried out to connect two pairs of wires.

Figure 14:
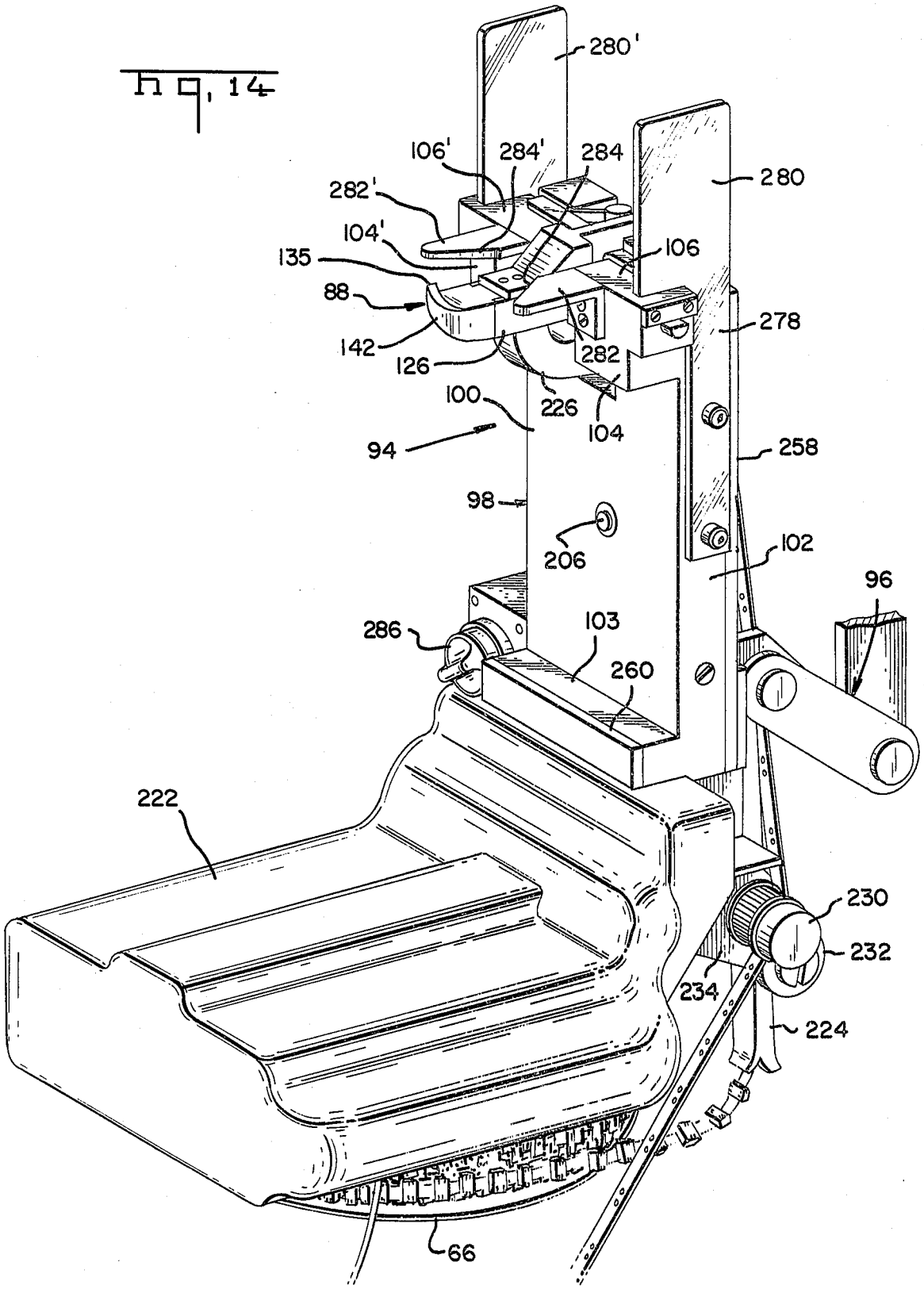

FIG. 14 is a perspective view of an apparatus in accordance with the invention.

Figure 15:
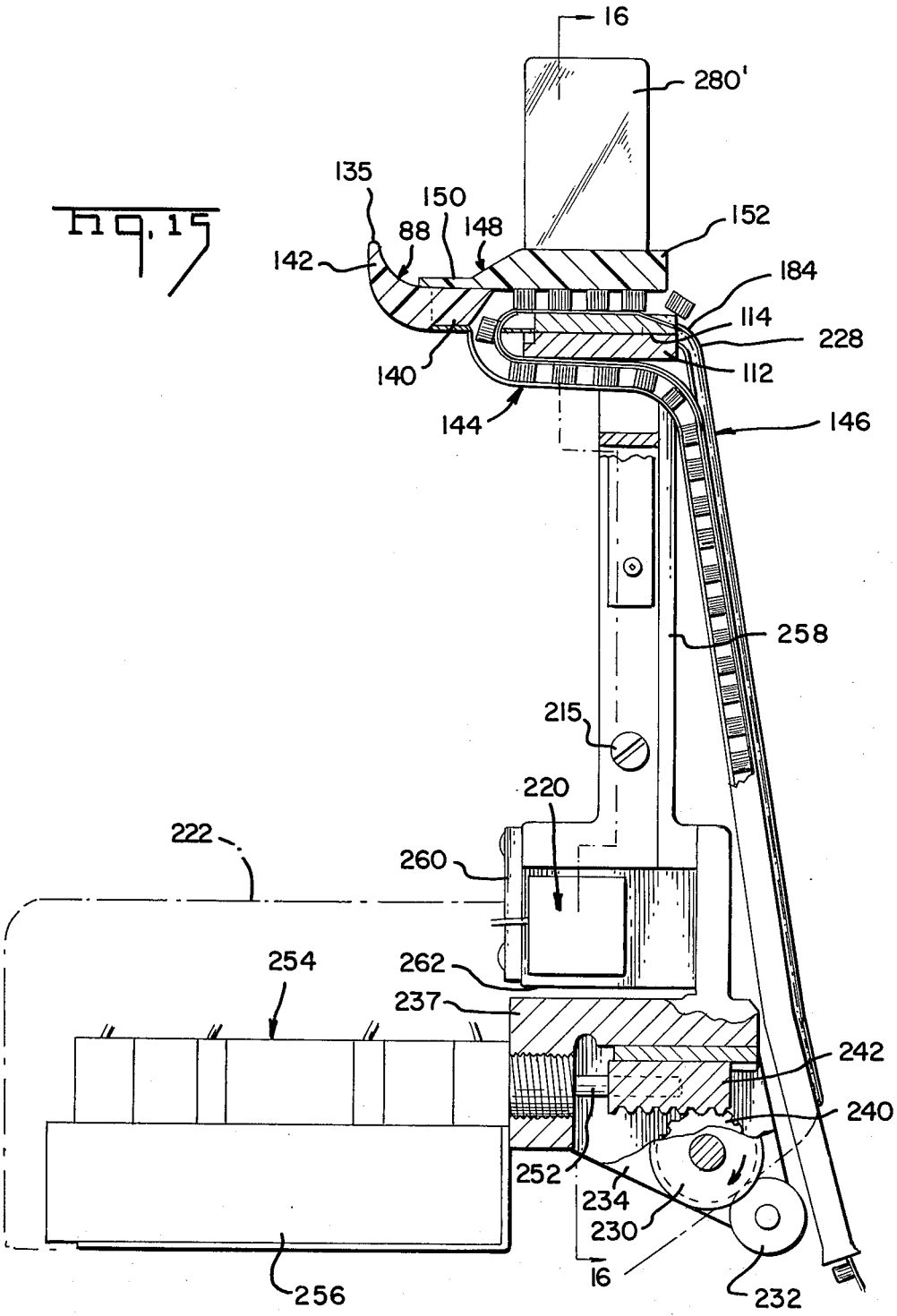

FIG. 15 is a sectional side view of the apparatus of FIG. 14.

Figure 16:
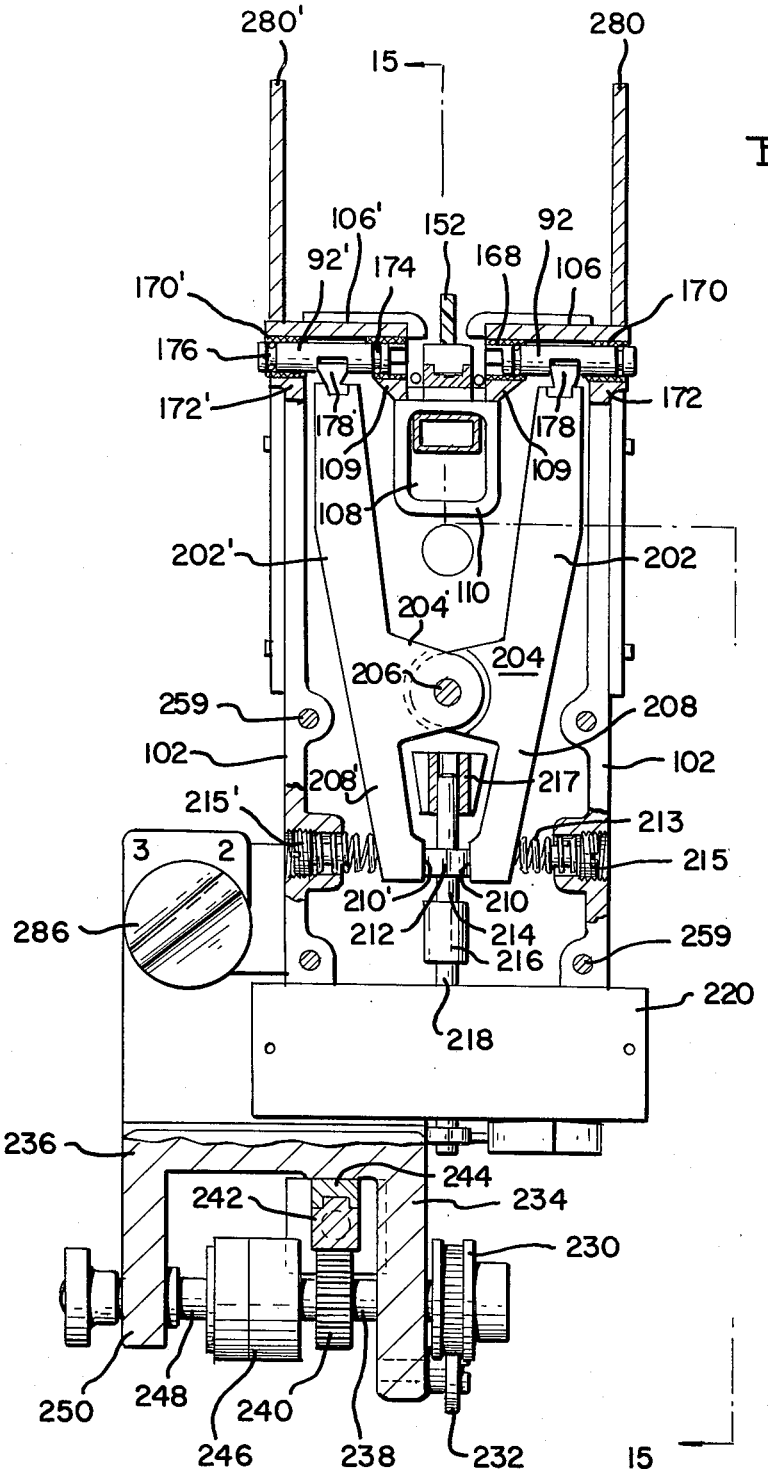
Figure 17:
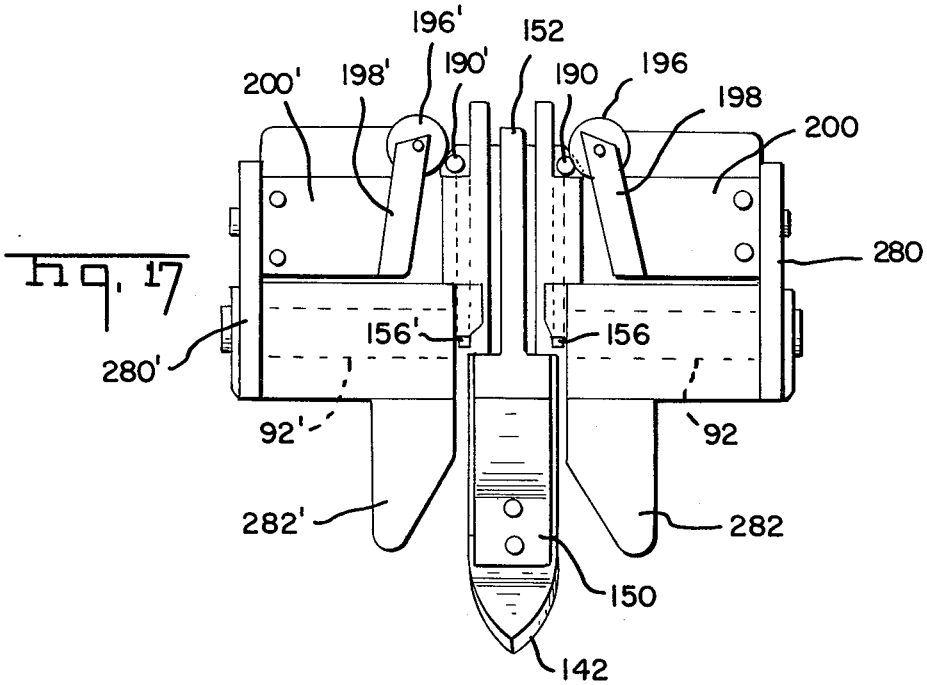

FIG. 16 is a sectional view taken along the line. 16—16 of FIG. 15.

Figure 17:
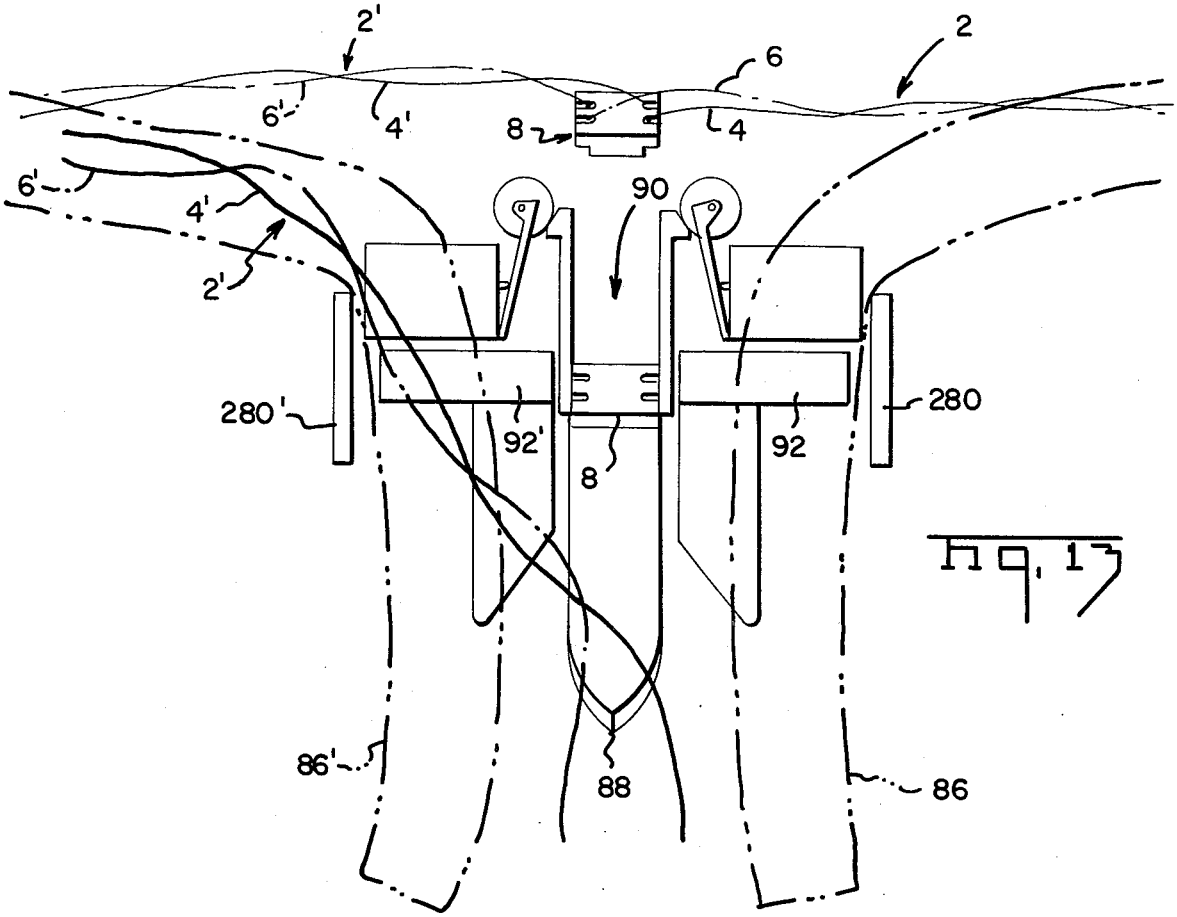

FIG. 17 is a top plan view of the apparatus.

Figure 18:
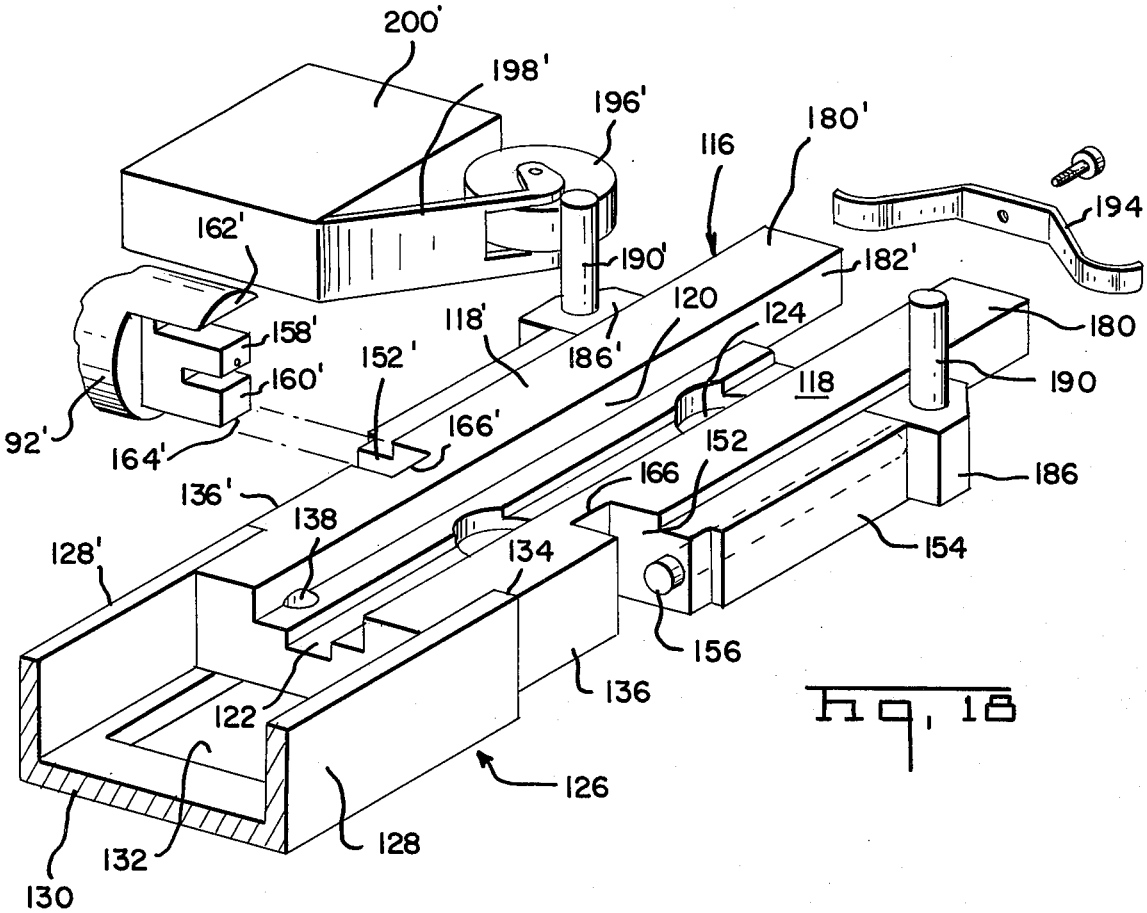

FIG. 18 is a perspective view of the anvil and guide block which forms a part of the apparatus and showing fragmentarily some associated elements which are located adjacent to the guide block.

Figure 19:
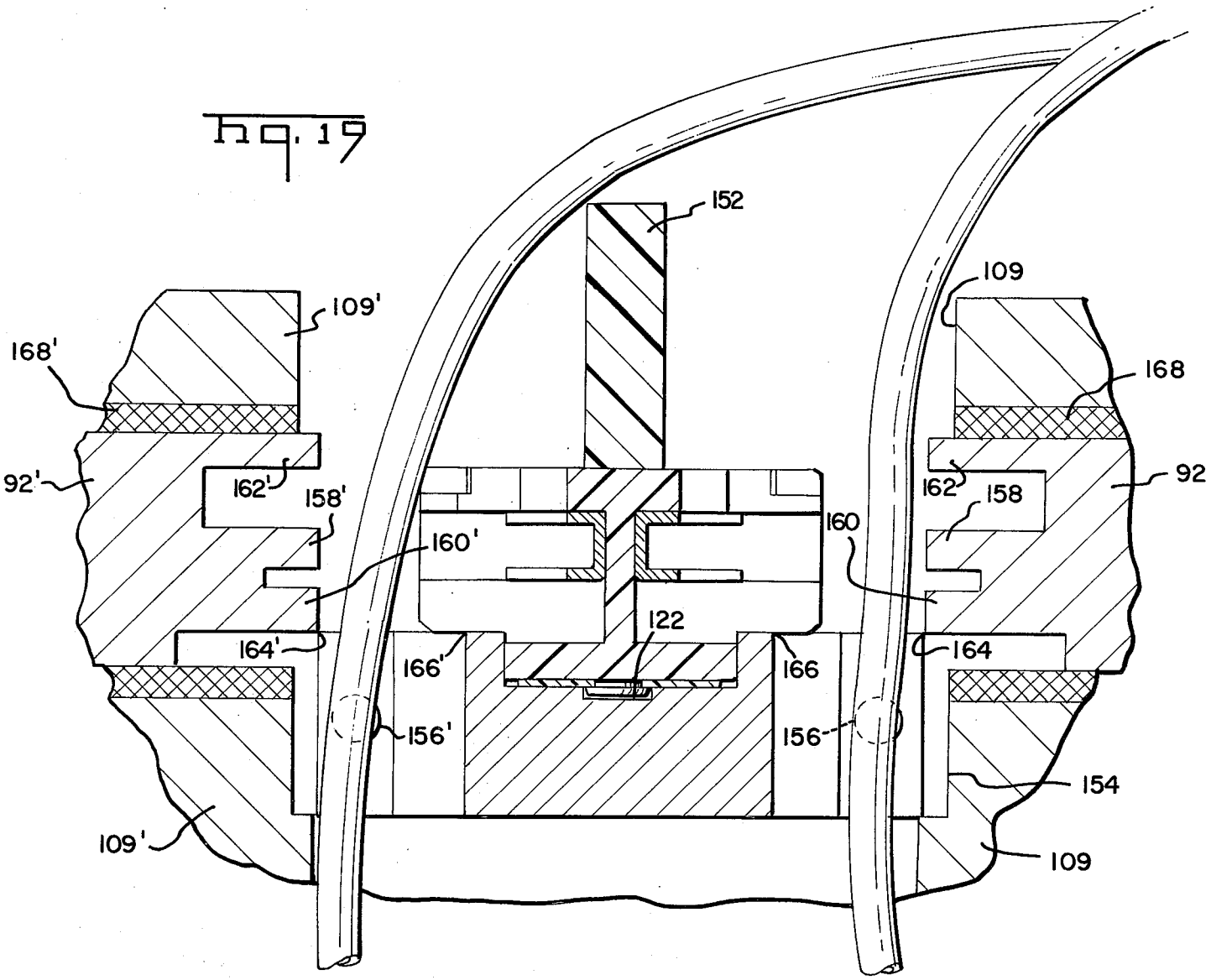

FIG. 19 is a fragmentary top plan view on an enlarged scale and partially in section showing the central section of the operating zone, this view illustrating the manner in which a wire pair is located in the operating zone.

Figure 20:
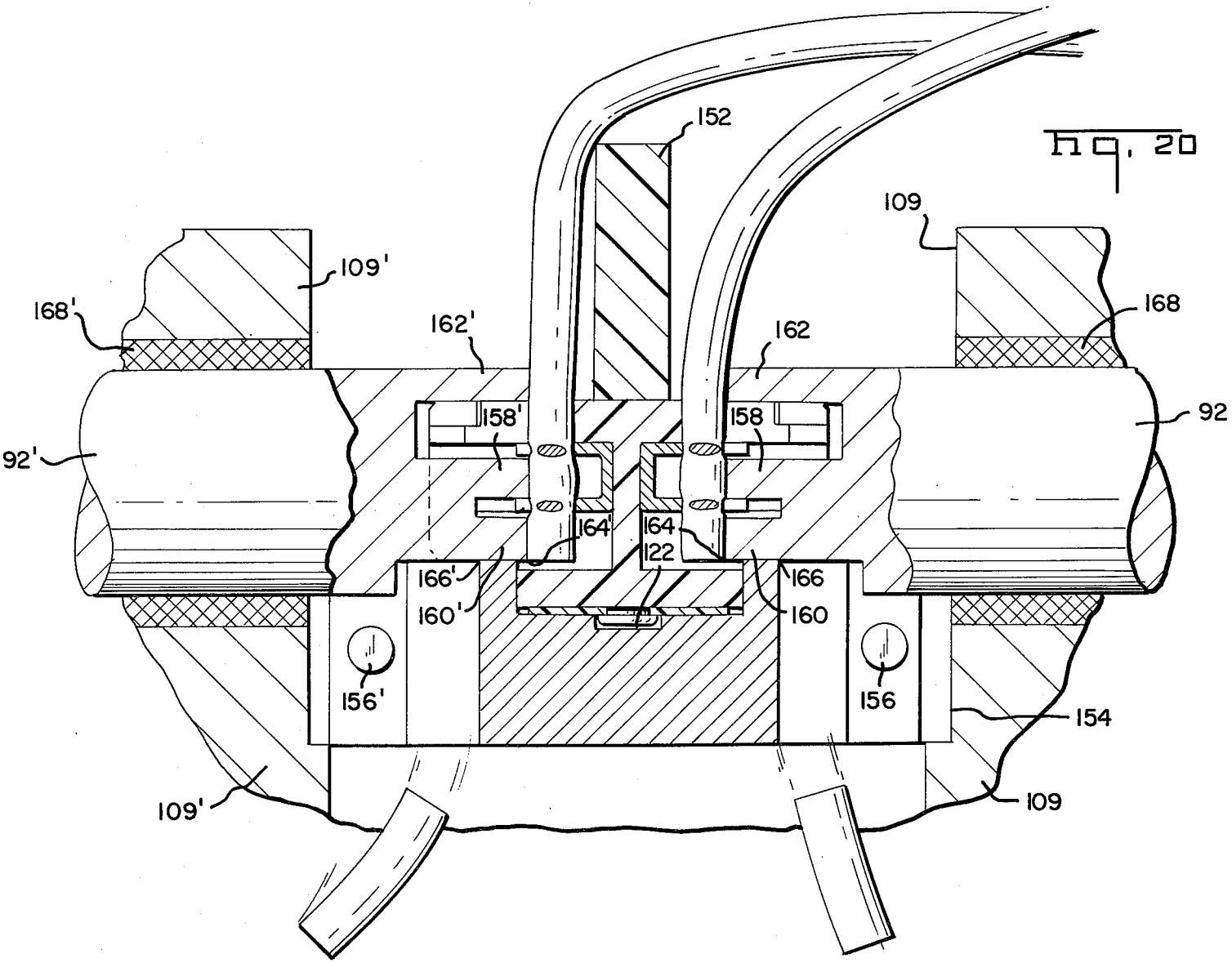

FIG. 20 is a view similar to FIG. 19 but illustrating the positions of the parts after the inserters have inserted the wires into the connecting device.

Figure 21:
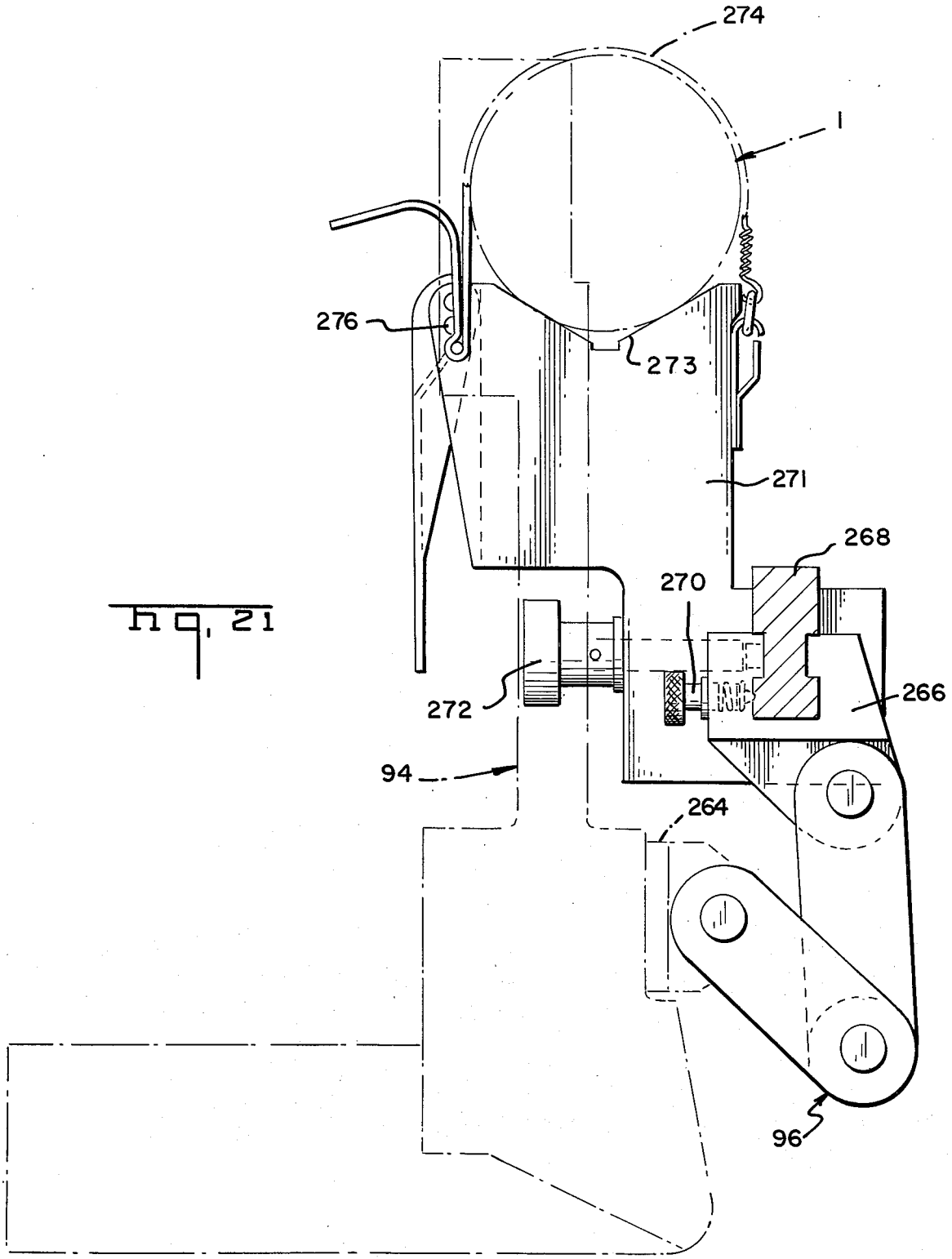

FIG. 21 is a side view taken through a portion of a cable illustrating the manner of supporting the apparatus on the cable at a work site.

Figure 22:
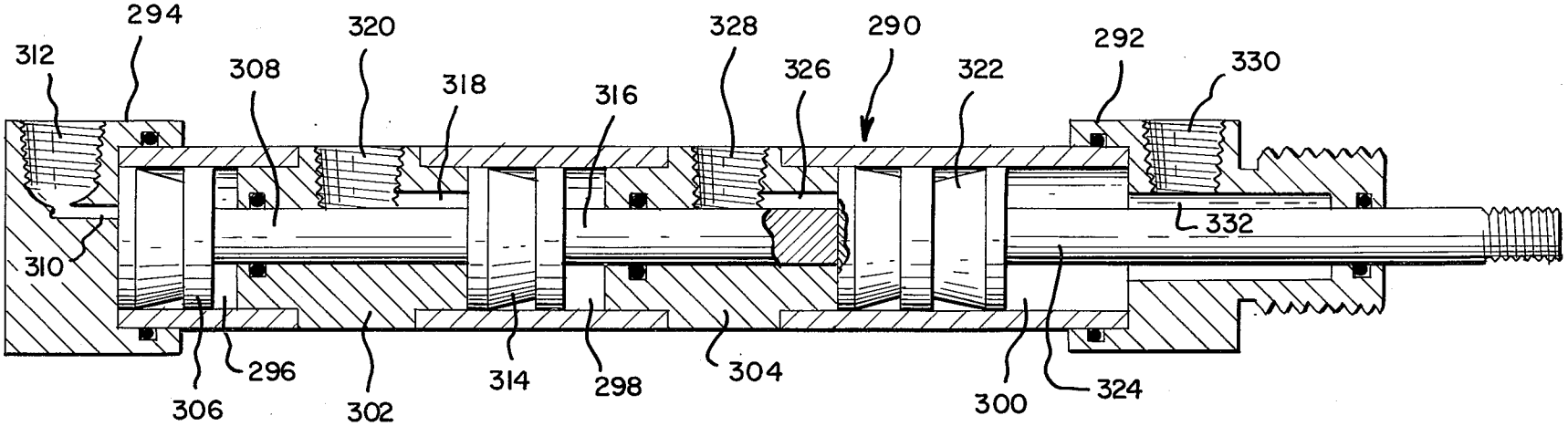

FIG. 22 is a cross-sectional view of a linear actuator which forms part of the disclosed embodiment.

Referring first to FIG. 13, the instant invention is normally used to connect the corresponding wires of two pairs 2, 2′ of wires to each other in separate electrical connections. Each pair 2 comprises insulated wires 4, 6 and each pair 2′ comprises wires 4′, 6′.

The wires are connected to each other by means of connector 8, each connector comprising a generally prismatic housing 10 having a front wall 12, a back wall 14, sidewalls 16, 18 and oppositely directed wire receiving ends 20, 20′. The housing 10 is symmetrical about its central axis as shown by FIG. 2 and the same reference numerals, differentiated by prime marks, are accordingly used to denote corresponding structural features on the right and left hand sides of this central axis.

Wire receiving recesses 22, 22′ extend into the wire receiving ends 20 and are separated by a central barrier wall 23. Each recess 22 has a pair of spaced apart extensions 24 (FIG. 3A) which extend towards the back wall 14 and which are separated by a barrier 26. These extensions receive the ends of the wires as will be described below.

A metallic electrical connecting device 28 is mounted in each recess 22 and is generally U-shaped having a web 30 and sidewalls 32, 32*a*. The sidewalls are provided with wire-receiving slots which extend inwardly from their free ends as shown at 34, 34*a* and 36, 36*a*. The slots 36*a*, 34*a* are preferably relatively more narrow than the slots 34, 36 so that when a wire is moved laterally of its axis into a pair of aligned slots 36, 36*a* or 34, 34*a*, the narrower slot in the sidewall 32*a* will displace the insulation of the wire to a substantial degree and establish electrical contact with the conducting core. The edges of the wider slot in the sidewall 32 will penetrate and displace the insulation of the wire to a lesser extent. The slot in the sidewall 32 functions as a mechanical strain relief to protect the electrical contact against damage when an axial pull is applied to the wire. Additional slots 38 in the sidewalls 32, 32*a* may be provided to permit flexure of the sidewalls when wires are inserted into the wire-receiving slots 34, 34*a* and 36, 36*a*.

The connecting devices 28, 28′ fit snugly in the recesses 22, 22′ with the sidewalls 32, 32′ against the internal surface of the front wall 12. Wire admitting slots 40, 42 and 40′, 42′ extend inwardly from the ends of the housing in the front wall 12 to permit passage of the wires into the slots of the connecting devices.

Referring to FIG. 4, each of these wire admitting slots has an entrance portion having convergent edges 44 and this entrance portion merges with an intermediate portion 46 having parallel edges. Each slot extends obliquely as shown at 48 from the parallel edge portion to an enlarged inner end 50 with which the associated wire receiving slots of a connecting device 28 are in alignment. A recess 52 extends from the inner end portion 50 towards the adjacent sidewall 16 or 18 so that a portion 54 of the front wall can function as a flexible arm when the wire is moved into the device and through the wire admitting slot. The end 56 of this arm bears against the wire and prevents its unintentional removal.

The backwall 14 is cut away at its sides as shown at 60, FIG. 3, and the previously identified barrier 26 extends beyond the marginal side portion 60 of the backwall. These features permit the movement of tooling into wire receiving ends of the connecting device as will be described below. It whould be added that in the completed cable splice, which contains a large number of closely packed connectors 8, the barriers 26 of the individual connectors serve the purpose of maintaining a minimum distance adjacent connectors and particularly between the metallic connecting members 28 in adjacent connectors. It is desirable to maintain this minimum spacing for the purpose of preventing arcing or other undesirable electrical effects.

FIGS. 4–6 illustrate the movement of wires 4, 6 into one end of a connector 8. As shown by FIG. 4, the wire 4 is located in the entrance portion of the appropriate wire admitting slot with its axis extending transversely with respect to the associated metallic connecting device 28. The wire is moved laterally of its axis into wire admitting slot and simultaneously into the slots 34, 36 until it is fully inserted as shown in FIG. 6. During movement of the wire 4 through the wire admitting slot, the portion 54 of the front wall is flexed laterally and the central portion of the front wall is also resiliently deformed. After insertion of the wire is completed, the previously identified end 56 of arm 54 bears against the wire so that it cannot be moved laterally of its axis from the connector. It is thus apparent that two modes of strain relief are provided; the strain relief slot 34 or 36 protects the electrical contact against an axial pull on the wire and the arm 54 protects the wire against laterally directed forces.

It will be apparent from FIG. 6 that if the wires 4, 6 are inserted one at a time, the central portion of the front wall will be permitted to flex in the appropriate direction. However, all of the wires can be inserted simultaneously if desired and the center portion of the housing will be compressed.

Connectors in accordance with the invention are advantageously provided to the user on a continuous strip of thin film material 62 in spaced-apart relationship to each other with their wire-receiving ends 22, 22′ facing laterally of the axis of the strip. The housings 10 are advantageously of a thermo-plastic material such as a glass-filled nylon which can be injection molded. The preferred manufacturing process is to provide holes in the carrier strip 62, feed the carrier strip through the mold of the molding machine, and mold the housings onto the carrier strip 62, the mold cavity having recesses to permit flow of molding material through the holes in the carrier strip so that studs 64 are formed on the underside of the carrier strip. The studs secure the housings 10 to the carrier but the individual housings are readily removed under controlled conditions in the apparatus as will be described below. The carrier strip should be thin and flexible and must be capable of withstanding the molding temperature of the material of the housing 10 without deterioration. Mylar (polyethyleneterephthlate) has been found to be a material which has the required properties and it appears to be ideally suited for connectors as shown. Alternatively, the carrier strip can be of thin steel in a suitable flexible temper or an alternative plastic material such as Kapton.

Figure 10:
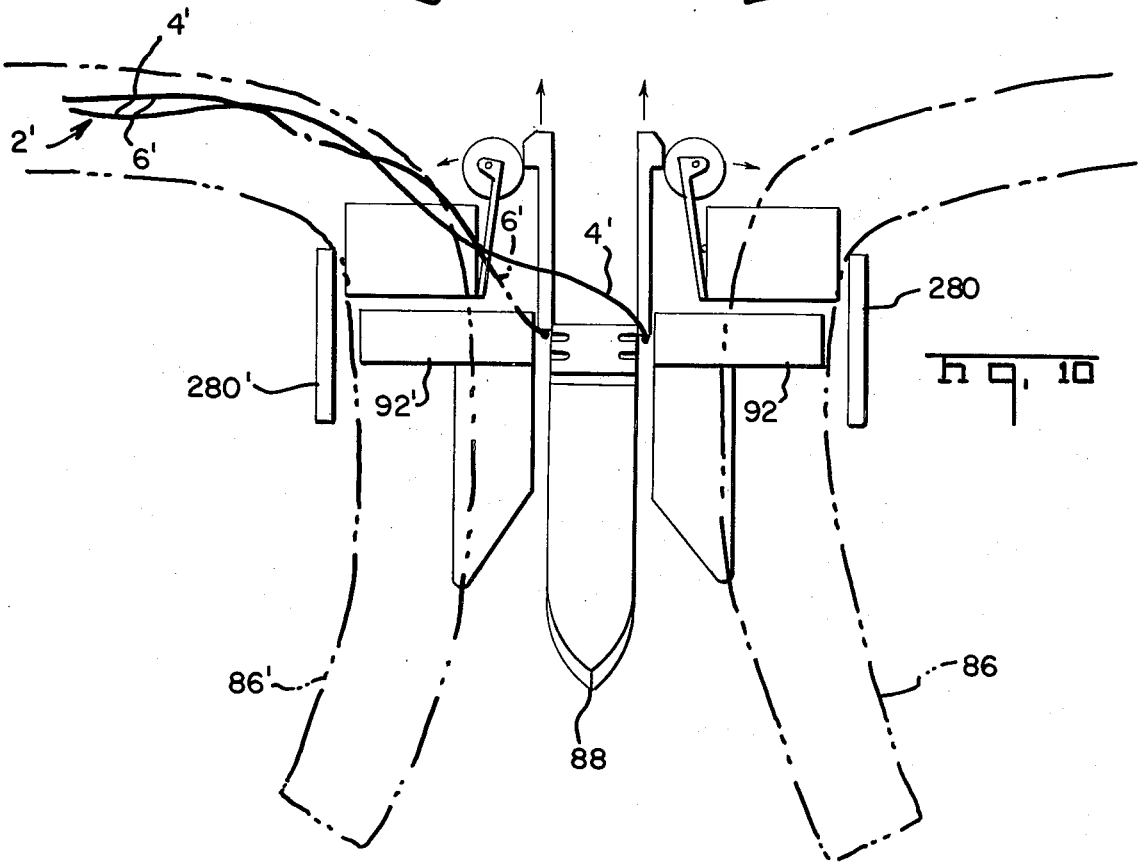
Figure 11:
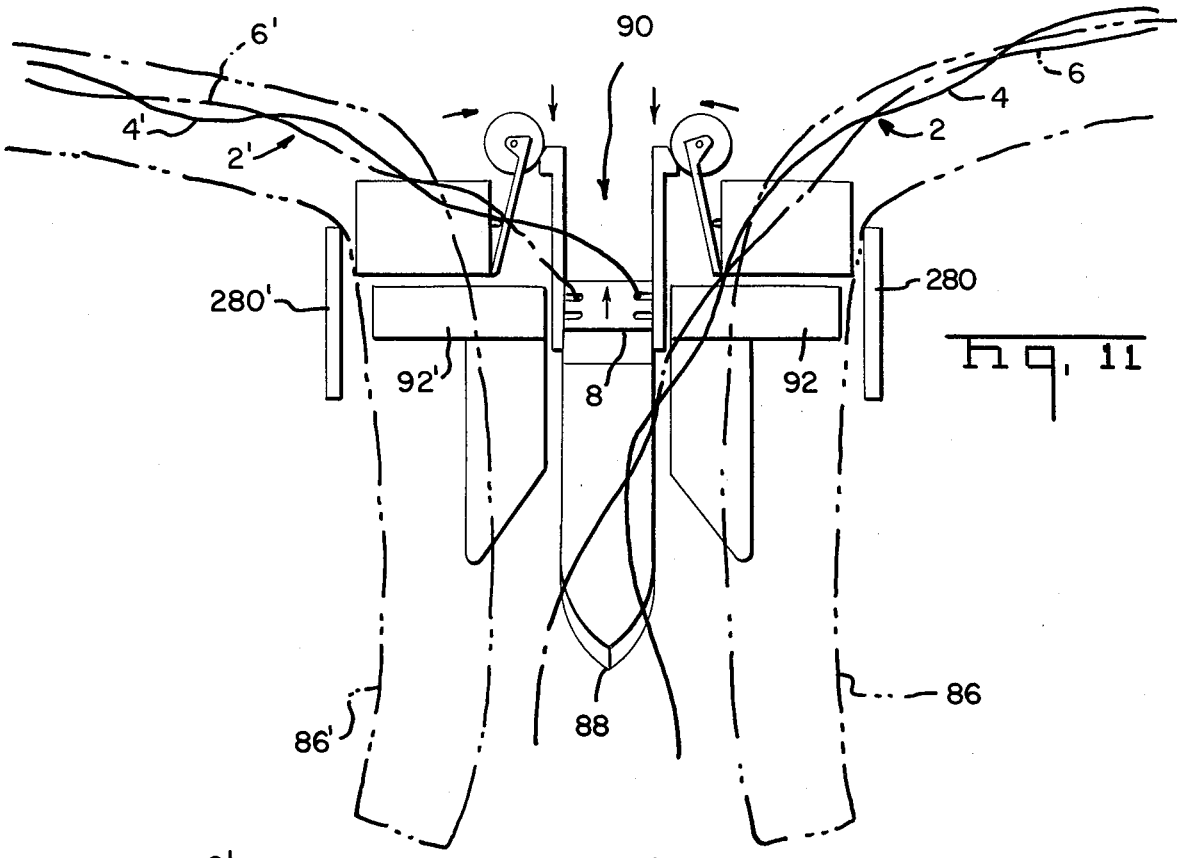
Figure 12:
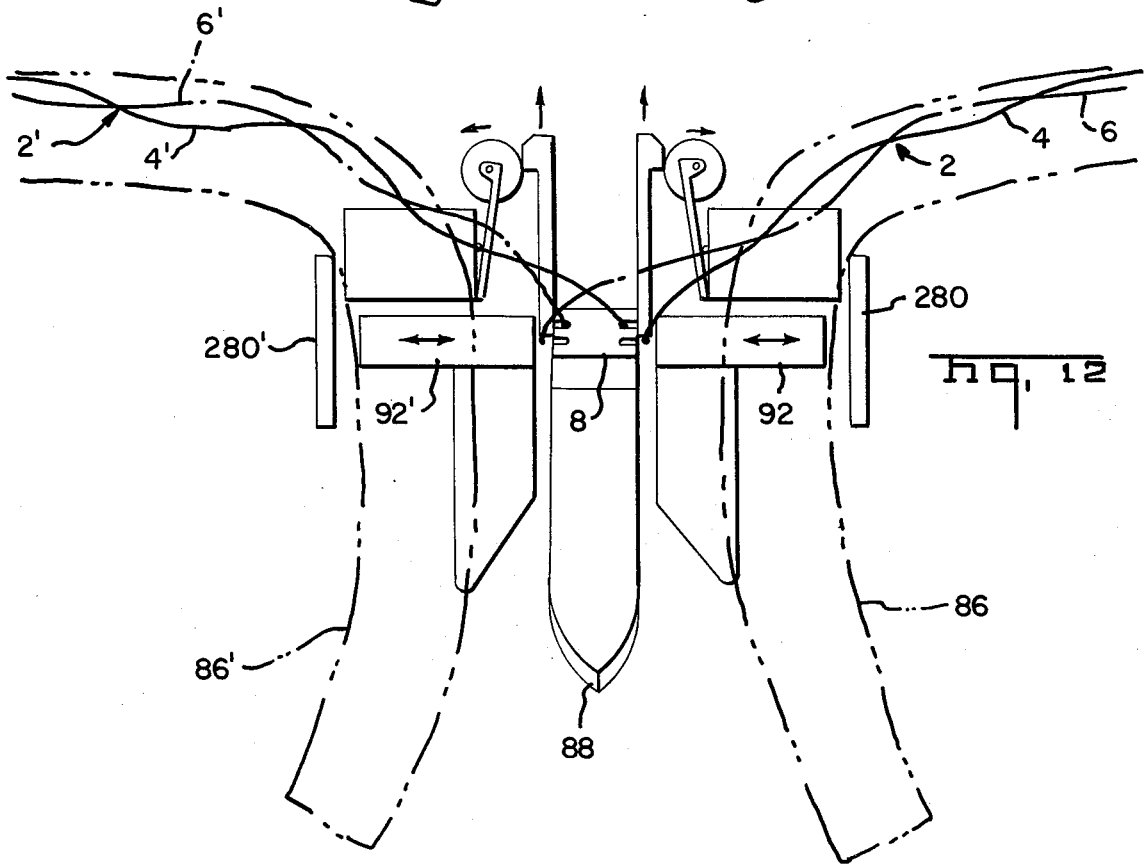

As noted previously, connectors in accordance with the invention can be applied to wires at a very high rate if an apparatus as disclosed below is employed. The features of the connector strip disclosed herein which contribute to this high production rate can be appreciated from a review of FIGS. 9–13 which show diagramatically the essential structural features of the apparatus which is shown in detail in FIGS. 14–21. FIGS. 9–13 illustrate the handling procedures involved in a typical cable splicing operation when connectors in accordance with the invention are used. As shown in FIG. 9, a bundle of wire pairs 86, 86' from each cable will, during operation, be positioned on the upper end of the apparatus on each side of a wire splitter 88 and on each side of an operating or application zone 90. Wire-inserting and trimming punches 92, 92' are mounted in the operating zone on each side of, and in alignment with, the wire-receiving ends of a connector 8. The procedure which is followed to connect the corresponding wires of a wire-pair in the bundle 86' to a wire pair in the bundle 86 is to select a pair 2' from the bundle 86' and move the pair laterally from the bundle then downwardly over the splitter 88 until one wire is in alignment with each of the inserters 92, 92'. The inserters are then moved towards the connector 8 and the wires are trimmed and inserted into t he wire-receiving ends of a connector. Thereafter as shown in FIG. 11, a pair 2 is selected from the bundle 86 and similarly moved over and past the splitter 88 until the wires are in alignment with the connector and the inserters. The inserters are again moved towards the connector, FIG. 12, to insert and trim the wires. At the conclusion of this step, the wire 4 will be connected to the wire 4' in the metallic channel shaped connector in the righthand portion of the connecting device 8 and the wire 6 will be connected to the wire 6' in the lefthand portion of the connecting device. At the beginning of the next operating sequence, the next adjacent connecting device is advanced to the operating zone and the connector which was previously installed on two pairs is ejected from the apparatus and delivered to a location between the ends of the cables from which the bundles extend.

It is expected that the method and apparatus of the invention will be used most of the time for cable splicing operations as described above. However, there are many occasions when tap wires must be connected to the wires of the cable intermediate the ends of the cable. Referring to FIG. 8A, a tap wire connection of a tap pair 70 to a through wire pair 68 is made by connecting the individual wires 82, 84 of the pair 70 to the wires 78, 80 of the through wire pair 68. The apparatus which is briefly described above and which is described in detail below can be used to make tap type connections as shown in FIG. 8 by merely substituting connecting devices of the type shown in FIG. 7 for the previously described connecting devices of FIG. 1.

The connector 71 for making tap connections comprises a housing 72 which is mounted on a carrier strip and which is generally similar to the previously described housing excepting that the individual metallic connecting members 74 each have three wire receiving slots 75 in each of their sidewalls and the front wall of the housing has three wire admitting slots 76, 76' as shown. The connecting device may have additional slots for permitting flexure of the sidewalls as shown.

When a plurality of tap connections are to be made to the wire pairs in a cable, the apparatus is set up adjacent to the cable as previously described and a bundle of wire pairs from the cable are positioned on one of the bundle supporting means on the upper end of the apparatus and beside the operating zone 90. The bundle of wires which are to be connected to the wires in the cable may be supported on the upper end of the apparatus on the other side of the operating zone.

The operator first selects a pair of uncut wires 68 from the bundle extending from the cable and moves the pair over the wire splitter and into the operating zone. When the inserters are actuated, the wires of the pair 68 will be cut and one of the cut ends of each wire will be inserted into the wire receiving slots at one end of each channel shaped metallic connecting means 74. The strip is then automatically indexed to locate the center wire-receiving slots 75 in alignment with the inserter. At this stage, the operator will have the free cut ends of the wires 78, 80 in his hands and he will move these wires over the splitter and into the operating zone 90. When the apparatus is again actuated, the inserters will trim these ends and insert them into the center wire receiving slots of the connecting devices 74. The individual wires 78, 80 of the through pair 68 will be uninterrupted electrically although the wires have been cut and the cut ends connected to each other by the connecting members 74. The strip is then advanced and the remaining wire receiving slots are positioned in alignment with the inserters. The operator then selects a pair 70 from the bundle of tap wire pairs, moves the wires of this pair over the splitter so that when the inserters are actuated, these tap wires will be trimmed and inserted into the connecting members. At the conclusion of this final insertion step of the cycle, the strip is advanced to position the next adjacent connecting device in the spacing zone as previously described.

Connectors as described above can be made in any desired size but the size will of course, be maintained at a minimum level in the interests of achieving a minimum volume in the cable splice. One particular embodiment of the invention comprises a housing which is about $0.5 \times 0.29 \times 0.26$ inch. It must be remembered that each connector functions to form two electrical connections between the two corresponding wires of the pairs.

Referring now to FIGS. 14–18, the disclosed apparatus 94 in accordance with the invention is mounted on an adjustable mounting bracket 96 and comprises a housing 98 having a front wall 100 from which sidewalls 102 extend rearwardly. A forwardly extending flange 103 is provided at the lower end of the housing and integral forwardly extending insertion punch housings 104, 104' are provided at its upper end. An opening 108 (FIGS. 15 and 16) is provided between the insertion punch housings and is surrounded by walls 110 as shown in FIG. 16. The insertion punch housings 104, 104′ have top walls 106, 106′ opposed sidewalls 109, 109′ and a connecting rib extends between these housings as shown at 112.

An anvil and guide block 116 (FIG. 18) is mounted on the upper surface 114 of the connecting wall 112 by means of siuitable fasteners which are threaded through openings 124 in the block 116. This anvil and guide block has a groove or channel 120 on its upper surface 118, which groove extends from the front of the apparatus between the integral insertion punch housings 104, 104′ and rearwardly of the apparatus. The floor of the channel 120 is provided with a central recess 122 and the width of the channel 120 is substantially equal to the distance between the cut away back wall surfaces 60 of the connecting device 8. It will be apparent from FIG. 15 that the strip of connectors can thus be fed over the upper surface of the block 116 and that the back walls of the housings will be received in the channel and the studs will be received in the recess 122.

The pair splitter 88 is mounted on the lefthand end of the block 116 by means of a channel-shaped support 126 having a web 130 and sidewalls 128. The web has an opening 132 adjacent to the end of the block to permit passage of the strip of connecting devices therethrough as illustrated best in FIG. 15. The sidewalls 128 of this support member 126 are received in notches 134 at the end of the block 116 and the support is fastened to the block 116 by suitable fasteners which extend through openings in the floor of the channel as shown at 138.

The splitter 88 has a lefthand portion 140 as viewed in FIG. 15 which has a generally rectangular cross-section and which is received in the lefthand end of the support 126. The splitter extends leftwardly in FIG. 15 from the support member 126 and has an upwardly turned and tapered prow portion 142. As will be apparent from FIG. 14, when a pair of wires is separated and moved downwardly over the cusp 135 of this prow, the wires will be guided laterally of their axes along the sidewalls of the support member and along each of the side surfaces 136, 136′ of the anvil and guide block.

The strip of connectors is fed upwardly behind the apparatus through a guide tube generally indicated at 144 and directed by a bend in the guide tube through the opening 132 in the web 130 of the support member 126. The strip advances through the channel 120, through the operating zone 90, in which the electrical connections are made, and the completed connections are released in a manner described below at the rearward end of the operating zone. The carrier strip is led from the operating zone through a return guide tube 146 to a feeding means which intermittently advances the strip.

It is desirable to provide an upper guide means in the operating zone and to this end, a top guide 148 is mounted on the upper surface of the portion 140 of the splitter 88. The top guide has a rib 152 which extends rearwardly over the guide channel 120, the lower edge of this rib being spaced from channel by a distance such that it will bear against the front walls 12 of the connectors on the strip as shown in FIG. 15.

As previously noted, the wires are cut and inserted in the operating zone by insertion and cutting members 92, 92′, the leading end of the insertion member 92′ being clearly shown in FIG. 18. The insertion member is cylindrical but is machined at its leading end to define three integral insertion punches 158′, 160′ and 162′. The insertion punch 162′ has a cylindrical upper surface and a flat lower surface while the punches 158′ and 160′ for flat side surfaces and are generally rectangular. As clearly shown in FIGS. 19 and 20, the faces of the punches 158, 158′ push the wires into the channel shaped connector means 28, 28′ while the punches 160, 160′ push the wires through the slots 58, 58′ and into the portions 24, 24′ of the recesses in the channel shaped connecting means. The ends or faces of the punches 162, 162′ push the wires through the wire admission slots in the front wall, the distance between the opposed sides of the punches 158, 158′ and 162, 162′ being such that this front wall is received therebetween as shown in FIG. 20.

Referring again to FIG. 18, the sides of the anvil and guide block 116 are provided with notches 152, 152′ which receive the leading ends of the inserters 92, 92′. Also, the edges 166, 166′ at the inner ends of these notches serve as fixed shears and cooperate with the edges 164, 164′ of the punches 160, 160′ to cut the wires immediately prior to insertion.

The notches 152, 152′ are located between the side wall portions 136, 154 of the sides of the block 116, the side portions 136, 136′ being inwardly spaced from the side portions 154, 154′. These later side portions 154, 154′ fit snugly between the opposed sidewalls 104, 104′ of the integral inserter housings while the side portions 136, 136′ are inwardly spaced so that the wires can be moved into the operating zone.

Valve control rods 156, 156′ extend slidably through openings in the block adjacent to the sidewall portions 154, 154′ and have slide blocks 186, 186′ on the ends. These slide blocks have upwardly extending pins 190, 190′ extending therefrom and the blocks are normally biased forwardly to the position of FIG. 18 by suitable leaf spring means 194 which is bolted to the rearward end of block 116.

When the two wires of a pair of wires are moved into the operating zone by the operator, they are brought to bear against the ends of the control rods 156, 156′ as shown in FIG. 19 and the rods are moved axially rearwardly, the blocks 186, 186′ sliding along the outwardly facing surfaces 188 of rearwardly extending rails 180. Referring to FIG. 17, during such rearward movement of the blocks 186, 186′, the pins 190, 190′ move rearwardly and into engagement with rollers 196, 196′ on control arms 198, 198′ which are part of valves 200, 200′ mounted on the upper surfaces of the inserter housings. When the condition of these valves is changed by the pins 190, 190′, the operating cycle is initiated as will be described below.

The inserters 92, 92′ are slidably mounted in sleeve bearings 168, 170 and 168′, 170′ (FIG. 16) which are supported in the housings 104, 104′ and in suitable bosses 172, 172′ in the sidewalls 102. Each cylindrical inserter is provided with grooves adjacent to its ends for sealing rings 174, 176 in order to seal the interior of the apparatus.

The inserters 92, 92′ are reciprocated towards and away from the connecting device 8 at the wire insertion station by levers 202, 202′ which are contained within the housing. The levers are connected to the inserters by dogs 178, 178′ mounted on the upper ends of the levers and somewhat loosely received in transverse grooves in the inserters, the levers being offset relative to the inserters so the dogs extend forwardly from the ends of the levers into the integral inserter housings 104, 104'. As shown best in FIG. 16, the levers normally extend downwardly and towards each other and have ears 204, 204' intermediate their ends by means of which they are pivotally mounted on a pivot pin 206 which extends from the internal surface of the front wall 100 of the housing. The lower ends 208 of the levers have opposed bearing surfaces 210 which are resiliently held against a cam 212 by springs 213. The springs are supported on the ends of pins having threaded heads 215 which are received in integral bosses in the sidewalls 102 of the cover plate.

Cam 212 is mounted on a vertically extending shaft 214, the upper end of which is supported in a bearing block 217 and the lower end of which is coupled by a coupling 216 to the output shaft 218 of a actuator 220. This actuator rotates the shaft 218 through one fourth of a revolution during each insertion cycle so that the levers are caused to drive the inserters inwardly towards the connector and then return them to their normal positions as shown in FIG. 16.

Advantageously, the actuator 220 is pneumatically driven and comprises a rack and pinion driven by an air cylinder, the pinion being on the shaft 218 and the rack being driven by a piston cylinder. Actuators of this type are commonly known and widely available. For example, a suitable actuator for the instant apparatus is a model RA–1 rotary actuator as produced by Rotomation Incorporated of Allandale, Fla.

Alternative actuators can be used for the inserters and for the strip feed mechanism described below, however, a completely pneumatic actuation means is highly desirable for cable splicing apparatus for the reason that many cable splicing operations take place in manholes in which there is a danger of the presence of an explosive gaseous mixture. It is common practice in the telephone industry to either prohibit the use of electrical actuators because of the danger of an explosion or to require explosion proof electric actuators which are expensive and unhandy.

As shown best in FIG. 15, the connectors which have been applied to wire pairs are separated from the carrier strip at the righthand end of the application zone by virtue of the fact that the carrier tape is fed downwardly through the guide tube 146 and the upper curved end 184 of this guide tube engages the rearward sides of the connectors during feeding of the strip and breaks the studs away from the carrier tape. After a connector has been released from the carrier tape, it is released from the apparatus immediately adjacent to, and between, the ends of the cable sections.

The strip of connecting devices is fed by a feed roller 230 and an idler roller 232 which pull the strip 62 (from which the connecting devices have been removed) as it emerges from the return guide tube 146. The feed roller 230 has flanged sides (FIG. 16) between which the carrier tape is received and is mounted on a shaft 238 which is supported in an arm 234 of a bracket 236 which in turn is secured to the lower end of a back plate 258 described below. Shaft 238 has a pinion 240 thereon which is engaged by a rack 242 on the end of a piston rod 252. The piston rod extends from a controlled stroke piston-cylinder 254 so that feeding strokes of different lengths can be obtained as will also be described below. The piston-cylinder extends forwardly at the lower end of the apparatus and is supported on a flange 237 on the bracket 236.

It will be apparent from FIGS. 15 and 16 that the feed roll 230 must be rotated in the feeding direction indicated by the arrow in FIG. 15 during forward or rightward movement of the rack 242 but the feed roll 230 must remain stationary on the shaft 230 during return movement of the rack. This selective rotation of the feed roll 230 is achieved by virtue of the fact that the pinion 240 is mounted for free rotation on the shaft 238 but is connected by a suitable key or pin means to a one-way clutch 246 which in turn is keyed to the shaft 238 in a manner such that when the clutch is rotated in a clockwise direction as viewed in FIG. 14, the clutch will rotate the shaft 238 but the clutch will rotate freely on the shaft 238 when the clutch is rotated in a counterclockwise direction as viewed in FIG. 15. One way clutches of the type which are commonly used in mechanisms of this type are widely available from different sources, one suitable clutch being manufactured by Form Sprag Inc. of Warren, Mich.

The piston cylinder 254 is controlled by the valve 200 to reciprocate the rack bar 252 and thereby advance the tape. A complete operating cycle in which the two wires of one pair are connected to the two wires of another wire pair requires (assuming that a connector is located in the operating zone) that the connector be fed a distance equal to the spacing between the slots 34, 34A and 36, 36A after the first pair of wires has been trimmed and inserted into the slots 34, 34A of the connecting device. This short stroke feeding step is, of course, necessary to align the slots 36, 36A with the insertion punches on the ends of the inserters. After the second pair of wires has been trimmed and inserted into the slots 36, 36A, the connector strip must be advanced by a distance sufficient to position the next adjacent connecting device 8 in the strip in the application zone with the slots 34, 34A in alignment with the insertion punches. These two different feed strokes are obtained by air logic valving contained in a housing 256 which is beneath the piston cylinder. A manual control or valve switch 286 is provided to change the feeding sequence of feed strokes when it is desired to perform cable tapping operations rather than splicing operations as described below.

Advantageously, the moving parts of the apparatus shown in FIG. 16 are sealed from the atmosphere by the back cover 258 of the housing which is secured to the sidewalls 102 by suitable fasteners as indicated at 259 in FIG. 16. The opening 108 through which the guide tube 144 extends is surrounded by walls 110 and since the back cover bears against these walls, corrosive agents are prevented from entering the interior of the housing through this opening. Additional sealing is of course, required such as the covers 260, 262 which surround the lower end of the housing and the actuator 220. The inserters 92, 92' are provided with circumferentially extending sealing rings 174, 176 at each end so that moisture cannot pass the sleeve bearings 168, 170. While the leading ends of the inserters must project into the operating zone, these leading ends can be protected against corrosion by suitable plating and/or selection of material. The apparatus can thus be used in humid environments such as in manholes or above ground in damp weather without fear of deterioration of vital parts.

Referring to FIG. 21, the apparatus is advantageously mounted on a mounting bar 268 which extends between, and which has its ends secured to, the ends of the cable or are otherwise supported. The apparatus is secured by means of a plate 264 to the positioning linkage 96 which in turn extends from a slide 266. The slide can be moved axially along the bar 268 and latched in a given position by a suitable spring biased detent 170. This arrangement permits movement of the apparatus parallel to the axis of the cable 1, FIG. 21, so that the numerous electrical connecting devices in the finished splice can be distributed evenly along the length of the cable splice. The cable ends are supported on support plates 271 which are also slidably mounted on the bar 168 and latched in a given position by a latching means or clamping screw 272. The upper ends of the plates 271 have cable supporting edges 273 and a strap 274 is provided for holding a cable against these edges, a suitable toggle clamp device 276 being used to clamp the cable against the edges.

Referring again to FIG. 14, it is desirable to provide bundle supporting bars 278 on each of the sidewalls 102, 102'. These supporting bars have upwardly extending ears 280, 280' adjacent to and on each side of the operating zone so that a bundle from each cable can be laid on the upper surfaces of the inserter housings 104, 104'. Finally, it is desirable to provide guide brackets 280, 282 which extend from the faces of the housings 104, 104' and which have inclined edges 284, 284' to further assist in guiding the wires into the operating zone.

In use, when the ends of two cables are to be spliced, the operator assembles the mounting bar structure shown in FIG. 21 and locates the upper end of the apparatus at a comfortable level for his particular requirements. A reel 66 of connecting devices which is mounted on a vertical axis beneath a reel cover 222 and the strip is fed through the tube 146 and through the operating zone. The leading portion of the strip, which does not have connectors thereon, is fed through the return tube 146 and threaded into the nip of the rolls 230, 232. The operator proceeds to select a pair of wires 2 or 2' from one bundle, moves the pair over the splitter 188 and into the operating zone and against the valve control rods 156, 156'. When the wires are properly located in the operating zone, the rods 156, 156' are moved rearwardly a distance sufficient to cause the pins 190, 190' to swing the levers 196, 196' and change the condition of the control valves 200, 200'. The inserters are driven inwardly by pressurization of the actuator 220 to trim and insert the wires as illustrated in FIGS. 10, 19 and 20. The strip of connecting devices is then advanced a distance sufficient to position the second set of wire-receiving slots in alignment with the inserters and the operator then selects a pair from the other bundle, passes the pair over the splitter, and locates the wires in the operating zone. The condition of the switches is again changed to actuate the inserters and to actuate the strip feed which, during this portion of the cylce feeds the strip a distance sufficient to advance the next adjacent connector into the operating zone. As the connectors 8 are moved from the operating zone, they are broken away from the carrier strip and deposited in the vicinity of the ends of the cables. It will be understood that the air logic system is programmed to provide the two different feeding steps which are required.

An overall advantage of the invention is that extremely high production rates can be obtained. As noted previously, studies have shown that an operator of ordinary skill can accomplish 500 to 600 pair connections per hour, that is, he can connect 600 pairs in the cable 1 to 600 pairs in the cable 1' per hour. By contrast, an ordinary operator can achieve only about 200–250 pair connections per hour with previous methods and cable splicing apparatus.

The high production rates which can be obtained in the practice of the invention are a result of several structural features which permit placement of the cables at a convenient location for the operator. Furthermore, the operator need move each pair of wires only a very short distance from the bundle 86 or 86' to the splitter 88. An appreciation of the fact that very little movement of the wires in the bundles is required can be gained if it is realized that the apparatus as viewed in FIG. 9 is only about 4 inches wide; that is the distance between the bundle supports 280, 280' is only about 4 inches, and the handling of each pair of wires requires only that the operator select the pair from the bundle, move the pair laterally a distance less than 2 inches, and then move it over the splitter a distance which does not exceed about 2 inches. The splitter is normally positioned below the operator's head so that the bundles 86, 86' are at a comfortable level for handling, say at about waist level or slightly above waist level of a seated operator.

The disclosed form of apparatus does not cause significant operator fatigue, notwithstanding the high production rates achieved by virtue of the fact that the connector feeding and wire insertion operations are all carried out by the powered actuators. Many of the previously available cable splicing devices required manual actuation for both the wire insertion operations and the strip feeding operations.

A significant structural feature of the apparatus is that the connecting devices are fed along a rectilinear path through the operating zone, over the anvil and guide block and towards the axes of the cables. This feeding method contributes to the fact that the apparatus can be made in an extremely compact size which in turn gives rise to the advantage of minimum wire movement and handling.

Finally, the compact size of the apparatus and the connectors results in a system in which very little work is required for each operating cycle (the work of feeding the strip and moving the inserters inwardly to insert the wires). Because of this fact, the actuators themselves require only a slight amount of energy for each operating cycle and the pneumatic actuation system can be operated for a long time period on a single tank of compressed gas. In fact, studies indicate that about 16,000 complete operating cycles (including the insertion of four wires into a single connecting device) can be obtained from one standard 224 cubic foot tank of compressed nitrogen. It is thus obviously entirely practical to use the apparatus in a manhole or elsewhere where the electrical energy or a compressed air line are not available.

It is expected that the method and apparatus of the invention will be used most of the time for cable splicing operations as described above. However, there are many occasions when tap wires must be connected to the wires of the cable intermediate the ends of the cable. A tap wire connection of a tap pair 80 to a through wire pair 68 as shown in FIG. 8A is made by connecting the individual wires 82, 84 of the pair 70 to the wires 78, 80 of the through wire pair pair 68. The apparatus described above can be used to make tap type connections as shown in FIG. 8 by merely substituting connecting devices of the type shown in FIG. 7 for the previously described connecting devices of FIG.

1 and changing the position of a selector valve 286 of the air logic system of the apparatus.

The connecting devices for making tap connections each comprise a housing 72 which is mounted on a carrier tap and which is generally similar to the previously described housing excepting that the individual metallic connecting numbers 74 each have three wire receiving slots 75 in their sidewalls and the front wall of the housing has three wire admitting slots as shown.

When a plurality of tap connections are to be made to the wire pairs in a cable, the apparatus is set up adjacent to the cable as previously described and a bundle of wire pairs from the cable are positioned on one of the bundle supporting means on the upper end of the apparatus, that is against one of the operating arms 280, 280' and beside the operating zone. The bundle of wires which are to be connected to the wires in the cable may be supported against the other one of the support arms on the other side of the operating zone.

The operator first selects a pair of wires 78, 80 from the bundle extending from the cable and moves the pair over the wire slitter and into the operating zone. When the inserters are actuated by closing of the valves 200, 200', the wires of the pair will be cut and one of the cut ends of each wire will be inserted into the wire receiving slots at one end of each channel shaped metallic connecting means 74. The strip is then automatically indexed to locate the center wire-receiving slots 75 in alignment with the inserter. The operator at this stage of the operating cycle will have the free cut ends of the wires 78, 80 in his hands and he will move these wires over the splitter and into the operating zone. When the apparatus is again actuated, the inserters will trim these wire ends and insert the wires into the center wire receiving slots of the connecting devices 74. At this stage, the individual wires 78, 80 of the through pair 68 will be uninterrupted electrically although the wires have been cut and the cut ends connected to each other by the connecting members 74. The strip is advanced during the second wire insertion operation and the remaining wire receiving slots are positioned in alignment with the inserters. The operator then selects a pair of 70 from the bundle of tap wire pairs, moves the wires of this pair over the slitter so that when the inserters are actuated, these tap wires will be trimmed and inserted into the connecting members. At the conclusion of this final insertion step of the cycle, the strip is advanced to position the next adjacent connecting device in the splicing zone.

FIG. 22 shows a cross sectional view of the actuator 254 by means of which the sequence of feeding steps described above is obtained. The actuator comprises a composite cylinder 290 having end caps 292, 294. The central body portion has three cylindrical cavities 296, 298, and 300, the cavities 296 and 298 being separated by a spacer 302 and the cavities 298, 300 being separated by a spacer 304. A piston 306 is contained in the cylindrical cavity 206 and has an integral cylinder rod 308 which extends through the spacer 302 to the cylindrical cavity 298. The cylindrical cavity 298 has a cylinder 314 therein having a piston rod 316 which extends through spacer 304 to the lefthand end of cylindrical cavities 300. The cylindrical cavity 300 likewise has a piston 322 therein having an integral piston rod 324 which extends through the cap piece and which is secured to the rack bar 242. It should be noted that the piston rods 308 and 316 are not secured to the piston 314 and 322 respectively. It should also be noted that the cylindrical cavity 296 allows for only a short stroke and the cavity 298 permits a stroke which is twice as long as that of the cavity 296. The cavity 300 permits a substantially longer stroke than the other two cavities. Motive fluid is admitted to the lefthand ends of the cylindrical cavities 296, 298, and 300 by means of inlet ports 310, 318 and 326 respectively, which in turn extend from threaded openings which receive fittings 312, 320, and 328. A threaded fitting opening 330 is provided in the cap piece 292 and a passageway 332 extending from this opening communicates with the righthand end of cavity 300 so that all of the pistons can be moved to the leftward limits of their strokes.

When a conventional splicing operation is being carried out, the piston 316 in the cavity 298 is not active and remains at the leftward limit of its stroke. After the first pair of wires has been inserted into the connecting device, compressed motive fluid is introduced into the lefthand side of the cavity 296 to move the piston rod 306 rightwardly for a distance sufficient to index the strip by an amount equal to the spacing between the two conductor receiving portions of the connecting device which is located in the insertion zone. The piston rod 316 moves the piston 322 rightwardly for a short distance during this portion of the cycle to move the rack bar 242 rightwardly as viewed in FIG. 15. After the second pair of wires has been connected to the connecting device, compressed motive fluid is introduced through the passageway 326 to the cavity 300 thereby to move the piston rod 324 rightwardly, the amount of movement being sufficient to advance the strip of connecting devices by a distance or amount which will position the next adjacent connecting device in the insertion zone 90.

When a splicing operation is being carried out, two short feeding strokes are required and in this instance, the piston 306 is first moved rightwardly to carry out the first feeding stroke. The piston 314 is then moved rightwardly to carry out the second feeding stroke, and the piston 322 is then moved rightwardly to position the next adjacent connecting device in the insertion zone. The actuator shown may be of the type produced by Rotomation Incorporated of Allendale, Fla. part No. SA 158.

The control system preferably incorporates extremely small valve mechanisms, for example, of the type shown in U.S. Pat. No. 3,618,636 and supplied by Dynamco Inc. of Dallas, Tex. The valves 200 are advantageously of the type supplied by the same company as model ML 3, minerature limit valves. The type of cycle (whether for splicing operations or tapping operations) is selected by a suitable selector valve 334 which again may be of the type manufactured by Dynamco, model R1 1.

What is claimed is:

1. Apparatus for repetitively connecting the corresponding wires of two pairs of wires to each other in separate electrical connections by means of connecting devices which have wire receiving ends, said ends facing in opposite directions, each of said ends having a wire connecting means therein, said devices being removably mounted on a continuous carrier strip in spaced-apart relationship with said wire-receiving ends facing laterally of said carrier strip, said apparatus comprising:

frame means having an operating zone, strip feeding means for feeding said strip along an operating zone strip feed path which extends through said operating zone from one end thereof to the other end thereof, said one end of said zone being proximate to an operator's position for said apparatus and said other end being remote from said operator's position, first and second bundle supporting means, said first bundle supporting means being on a first side of said strip feed path and said second bundle supporting means being on the second side of said path, said bundle supporting means having supporting means for supporting first and second bundles of wire pairs with said pairs extending generally towards said operator's position, first and second wire insertion stations in said operating zone on said first and second sides of said path respectively, said insertion stations being between said one end and said other end of said zone, said insertion stations having inserting and trimming means for trimming wires which extend normally of said path and inserting said wires into a connecting device positioned at said insertion station, and pair guiding means proximate to said one end of said zone, said guiding means having surface portions for separating the wires of a pair and guiding one of said wires to each of said insertion stations whereby, a pair of wires from a bundle on either of said bundle supporting means can be connected to connecting means in the wire-receiving ends of a connecting device at said insertion situation by moving said pair from the bundle to and over said guiding means so that one wire is at each of said insertion stations and then actuating said trimming and inserting means.

2. Apparatus as set forth in claim 1, said strip feeding means comprising:

means for sequentially feeding said strip a relatively short predetermined distance and for thereafter feeding said strip a relatively long predetermined distance, said apparatus being intended for use with connecting devices in which each of said wire connecting means has two wire receiving slots which are spaced-apart by a distance which is equal to said relatively short predetermined distance and said adjacent connecting devices are spaced apart by a distance which is substantially equal to said relatively long predetermined distance.

3. Apparatus as set forth in claim 1, said strip feeding means comprising means for sequentially feeding said strip through a first relatively short predetermined distance, through a second relatively short predetermined distance, and then through a relatively long predetermined distance, said apparatus being intended for use with connecting devices in which each of said wire connecting means has three wire-receiving slots therein which are spaced apart by distances which are equal to said first and second distances and adjacent connecting devices are spaced-apart by a distance which is substantially equal to said relatively long predetermined distance whereby, the corresponding wires of three pairs of wires can be connected to each other in separate electrical connections.

4. Apparatus as set forth in claim 1, said strip being on a reel, said apparatus having means on said frame means for mounting said reel.

5. Apparatus as set forth in claim 1, said operating zone having guide block means therein, said operating zone strip feed path extending over said guide block means.

6. Apparatus as set forth in claim 5, said guiding means comprising a guide member extending from said guide block means towards said operator's position.

7. Apparatus as set forth in claim 6, said guide member having a free end which is proximate to said operator's position, such free end having a point and having divergent guide surface portions extending from said point towards said insertion stations whereby, upon moving a pair of wires from one of said bundles over said point and moving one of the wires of said pair along said divergent guide surfaces, said wires will be guided to said insertion stations.

8. Apparatus as set forth in claim 5, each of said inserting and trimming means comprising a ram, said rams being normally disposed in a retracted position beside said path and being movable towards and away from said path to insert said wires into said connecting device at said insertion station.

9. Apparatus as set forth in claim 8 wherein said inserting and trimming means comprises fixed shears beside said path on each side thereof and edge portions of said rams, said edge portions being cooperable with said fixed shears to trim said wires during movement of said rams towards said path.

10. Apparatus as set forth in claim 9, said fixed shears comprising edge portions of said guide block means.

11. Apparatus for repetitively connecting the ends of two wires to connecting devices which have wire receiving ends, said ends facing in opposite directions, each of said ends having a wire connecting means therein, said devices being removably mounted on a continuous carrier strip in spaced-apart relationship with said wire-receiving ends facing laterally of said carrier strip, said apparatus comprising:

frame means having an operating zone, strip feeding means for feeding said strip along an operating zone strip feed path which extends through said operating zone from one end thereof to the other end thereof, said one end of said zone being proximate to an operator's position for said apparatus and said other end being remote from said operator's position, bundle supporting means on one side of said strip feed path, said bundle supporting means having supporting means for supporting a bundle of wires which extend generally towards said operator's position, first and second wire insertion stations in said operating zone on said first and second sides of said path respectively, said insertion stations being between said one end and said other end of said zone, said insertion stations having inserting and trimming means for trimming wires which extend normally of said path and inserting said wires into a connecting device positioned at said insertion station, and wire splitting and guiding means proximate to said one end of said zone, said splitting and guiding means having surface portions for separating the wires selected from a bundle on said supporting means and guiding one of said wires to each of said insertion stations whereby, wires from a bundle on said bundle supporting means can be connected to connecting means in the wire-receiving ends of a connecting device at said insertion situation by moving said wires from the bundle to, and over, said splitting and guiding means so that one wire is at each of said insertion stations, and then actuating said trimming and inserting means.

* * * * *